US006210349B1

(12) United States Patent
Naruse et al.

(10) Patent No.: US 6,210,349 B1
(45) **Date of Patent: *Apr. 3, 2001**

(54) ROLLER MASSAGING APPARATUS

(75) Inventors: Haruhiko Naruse, Shiga; Keiji Hata, Kyoto; Yoshiyuki Miyake, Osaka; Toyohito Hasegawa, Hyogo; Mikio Ito, Shiga, all of (JP)

(73) Assignee: Matsushita Electric Works, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/959,076

(22) Filed: Oct. 28, 1997

(30) Foreign Application Priority Data

Oct. 28, 1996 (JP) ..... 8-285719
Jun. 13, 1997 (JP) ..... 9-157204

(51) Int. Cl.[7] ..... A61H 15/00

(52) U.S. Cl. ..... 601/127; 601/126; 601/122; 601/28; 601/32

(58) Field of Search ..... 601/115, 122, 601/124, 126, 127, 134, 27, 28, 32

(56) References Cited

U.S. PATENT DOCUMENTS 4,599,997 * 7/1986 Bucher ..... 601/30
4,782,823 * 11/1988 Yamasaki ..... 601/127
4,852,553 * 8/1989 Voykin ..... 601/28
5,096,188 * 3/1992 Shen ..... 601/28
5,158,073 * 10/1992 Bukowski ..... 601/28
5,322,056 * 6/1994 Menghi et al. ..... 601/134

FOREIGN PATENT DOCUMENTS

325667 * 8/1989 (EP) ..... 601/28

* cited by examiner

*Primary Examiner*—Richard J. Apley
*Assistant Examiner*—Benjamin K. Koo
(74) *Attorney, Agent, or Firm*—Armstrong, Westerman, Hattori, McLeland & Naughton

(57) ABSTRACT

A roller massaging apparatus includes a massaging portion having a plurality of bar-shaped rotatable rollers. The rollers are circumferentially mounted to the massaging portion at a certain interval. The roller massaging apparatus also includes a driving mechanism for rotating the massaging portion around an axis thereof and a stimulating member disposed at an upper side of the massaging portion. The stimulating member is pushed up by the rollers. A mutual positional relationship between the massaging portion and the stimulating member is changed by moving as least one of the massaging portion and the stimulating member.

27 Claims, 27 Drawing Sheets

28
26
27
7
30
4
5
28
26
7
28
27
31a
7
28
5a
28
31b
28
29
23
24
22
25
25
11
24

5
46
47
7
46
7
5
46
7
8
46
7
46
41
21
44
9
4
42
22
9
11

Note: F.R.: Forward Rotation
R.R.: Reverse Rotation

Fig.19
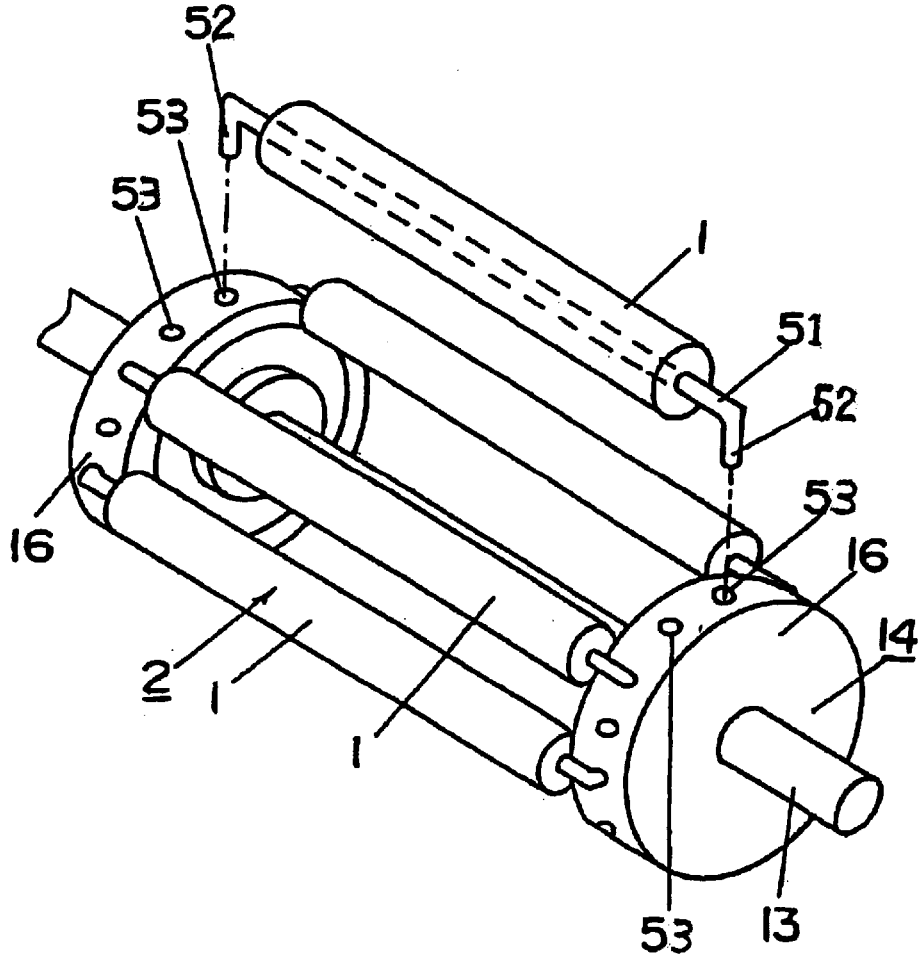
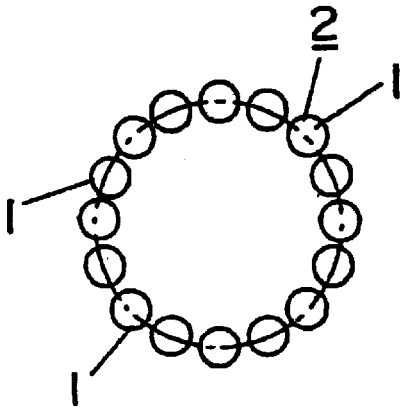
Fig.20A
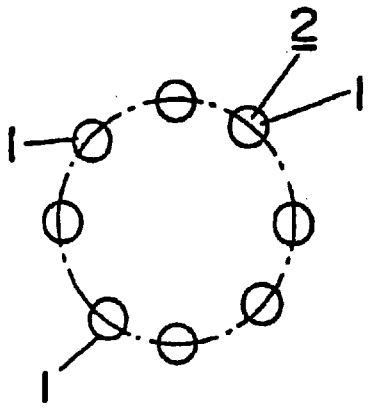
Fig.20B

ROLLER MASSAGING APPARATUS

BACKGROUND OF THE INVENTION

1. Field of the Invention

This invention relates generally to a roller massaging apparatus and more particularly, to a roller massaging apparatus for massaging a human body by rotating a massaging portion having a plurality of rollers.

2. Description of the Related Arts

A conventional roller massaging apparatus includes a massaging portion having a plurality of bar-shaped rotatable rollers disposed at certain intervals in a circumferential direction, a driving mechanism for rotating the massaging portion about the axis thereof, and a fabric disposed on a massaging surface side of the massaging portion. In the conventional roller massaging apparatus, the massaging portion having rollers rotates to stimulate the body of the user of the massaging apparatus via the fabric, which improves the circulation of the blood of the user of the roller massaging apparatus.

In the conventional roller massaging apparatus as mentioned above, there is the drawback that stimuli obtained by the rotational movement of the rollers via the fabric are monotonous and therefore, the conventional roller massaging apparatus cannot give very effective massaging effects.

The massaging portion rotates at a constant rotational speed in the same direction, which also causes the stimuli to be monotonous.

The rollers can not be detached from the massaging portion. Each roller has the same shape. Furthermore, a plurality of rollers are circumferentially disposed. Thus, stimuli obtained by the rotational movement of the massaging portion having rollers are monotonous and therefore, different stimuli can not obtained.

SUMMARY OF THE INVENTION

The present invention was made in view of the above-mentioned problems inherent in the conventional roller massaging apparatus, and therefore an object of the present invention is to provide a roller massaging apparatus which can easily give different stimuli.

According to the present invention, a roller massaging apparatus 4 includes a massaging portion 2 having a plurality of bar-shaped rotatable rollers 1. The rollers 1 are circumferentially mounted on the massaging portion 2 at certain intervals. The roller massaging apparatus 4 also includes a driving mechanism 3 for rotating the massaging portion 2 around an axis thereof, and a stimulating member 5 disposed at an upper side of the massaging portion 2. The stimulating member 5 is pushed up by the rollers 1. A mutual positional relationship between the massaging portion 2 and the stimulating member 5 is changed by moving at least one of the massaging portion 2 and the stimulating member 5. Therefore, a body of the user of the roller massaging apparatus 4 which is placed on the stimulating member 5 is strongly stimulated by the stimulating member 5 which is pushed up by a plurality of rollers 1 when the massaging portion 2 is rotated. Massaging effects by the stimulating member 5 can be changed by changing the mutual positional relationship between the massaging portion 2 and the stimulating member 5 by moving at least one of the massaging portion 2 and the stimulating member 5.

The mutual positional relationship between the massaging portion 2 and the stimulating member 5 may preferably be changed by moving the stimulating member 5. This allows for changing the massaging effects obtained by the stimulating member 5 by means of moving the stimulating member 5.

The stimulating member may be detachably attached to the roller massaging apparatus 4. This allows for cleaning of the stimulating member 5 by means of detaching the stimulating member 5, exchanging the stimulating member 5 when the stimulating member 5 is worn down, exchanging the stimulating member 5 for a different one to obtain different stimuli, detaching the stimulating member 5 to obtain less stimulating massaging effects.

The stimulating member 5 may be movable and the roller massaging apparatus 4 may further include a stopping means 6 for stopping and holding the stimulating member 5 at a certain position. This enables the stimulating member 5 to stop at a desired position to massage at a predetermined stimulus level.

The stimulating member 5 may preferably be provided with protrusions 7 which are different in shape. By moving the stimulating member 5, different massaging effects can be obtained by different stimulating protrusions 7.

The stimulating member 5 may preferably be provided at either a region with stimulating protrusions 7 and a region with no stimulating protrusions 7 so as to obtain strong stimuli from the region with stimulating protrusions 7 and soft stimuli from the region with no stimulating protrusions 7.

The stimulating member 5 may be provided with a foot-shaped region having stimulating protrusions 7 to effectively massage the sole of the foot of a user of the roller massaging apparatus 4.

The foot-shaped region may be provided with stimulating protrusions 7 at points corresponding to the portion of the sole of the foot of the user of the roller massaging apparatus 4 so as to effectively massage the sole of the user's foot.

The stimulating member 5 may be provided with right and left foot-shaped regions having stimulating protrusions 7, wherein the stimulating protrusions 7 of the right and left foot-shaped regions are different in position so as to correspond to right and left foot points to be massaged. This enables effective massage of the sole of the foot of the user of the roller massaging apparatus 4 on both the user's right and left foot.

The stimulating member 5 may be provided with a positioning means 10 for correctly positioning the sole of the foot of the user of the roller massaging apparatus 4 with respect to the stimulating protrusions 7.

The stimulating member 5 may be formed of elastic materials to enable easier response of the stimulating member 5 corresponding to the stimuli from the rotation of the roller 1, which in turn more easily transmits the rotational stimuli to the body of the user of the massaging apparatus 4 via the stimulating member 5.

The stimulating member 5 may be attached on a movable sheet 8. When the stimulating member 5 is made of elastic materials, the stimulating member 5 creates much friction and therefor, is hard to move. However, the sheet 8 with the attached stimulating member 5 can easily be moved due to the fact that there is a lesser amount of friction created.

Furthermore, the sheet 8 can have a region with no stimulating members 5 and still obtain the same massaging effects as the massaging effects of a sheet with entirely no stimulating member 5. Thus, not all of the stimulating member 5 need to be removed from the sheet 8, if the region with no stimulating members 5 is positioned on the roller 1.

The stimulating member 5 may be detachably attached on the sheet 8. This enables the user to easily use the roller massaging apparatus 4 without the stimulating member 5 by detaching the stimulating member 5.

The sheet 8 with the attached stimulating member 5 may be detachably mounted to the roller massaging apparatus 4. This allows the user to easily clean the dirty stimulating member 5, to exchange a worn out stimulating member 5 for new one, or to exchange the stimulating member 5 for any one of stimulating members 5 selected from different kinds of stimulating members used for stimulating in conventional massaging apparatus without using the stimulating member 5 of the present invention.

The sheet 8 with the attached stimulating member 5 may be put around sheet rotating rollers 9 so as to smoothly move the sheet 8 with stimulating member 5.

The roller massaging apparatus 4 may be provided with a stopping means 6 for stopping and holding the sheet 8 with the attached stimulating member 5 at a certain position to have a desired massaging stimulus.

The roller massaging apparatus 4 may be provided with a driving means for driving the stimulating member 5 to automatically move the stimulating member 5 to a desired position.

The stimulating member 5 may have a plurality of massaging sheets 60 and the massaging sheets 60 may be connected with one another by a connecting member 61. This enables easy and correct movement of a first massaging sheet 60 when a second massaging sheet 60 is moved with respect to the first massaging sheet 60.

The stimulating member 5 may be provided with right and left massaging sheets 60 and the massaging sheets 60 may be connected by connecting members 61 at fore-and-aft portions of a moving direction of the stimulating member 5. This allows either one of the right and left massaging sheets 60 to move when the other of the left and right massaging sheets 60 is moved and also allows one to clearly distinguish the massaging sheet 60 from the connecting members 62, thereby making the foot placing area clear. Further, because the connecting members 62 are formed at fore-and-aft portions, the massaging sheets 60 can be effectively pushed up by the roller 1 without heavily hindering by the connecting members 62.

The stimulating member 5 may be movable so as to take any one of two kinds of massaging positions, i.e., either a position in which the stimulating member 5 is located above the massaging portion 2 or a position in which the stimulating member 5 is not located above the massaging portion 2. The roller massaging apparatus 4 may further include a stimulating member moving portion 62 for moving the stimulating member 5 which is not positioned above the massaging portion 2. This allows for a massage with no stimulating member 5. This also enables the stimulating member 5 to easily move from the position where the stimulating member 5 is not positioned above the roller 1 to the position where the stimulating member 5 is positioned above the massaging portion 2 by pushing the stimulating member moving portions 62.

The roller massaging apparatus 4 may include a massaging portion 2 having a plurality of bar-shaped rotatable rollers 1, wherein the rollers 1 are circumferentially mounted on the massaging portion 2 at a certain interval, a driving mechanism 3 for rotating the massaging portion 2 around an axis thereof, and a control means for automatically changing rotational speed and/or rotational direction of the rollers 1. This enables the massage stimulus to follow the massaging pattern of a professional massager.

The stimulating member 5 may be automatically moved to predetermined positions. This also enables the massage stimulus to follow the massaging pattern of a professional massager.

The roller massaging apparatus 4 may include a massaging portion 2 having a plurality of bar-shaped rotatable rollers 1, wherein the rollers 1 are circumferentially mounted on the massaging portion 2 at a certain interval, a driving mechanism 3 for rotating the massaging portion 2 around an axis thereof, and a control means for controlling a rotational speed of the massaging portion 2 so as to start at a predetermined low speed in the beginning stage of the rotation of the massaging portion 2.

In operation, the above-described structure of a roller massaging apparatus 4 allows the stimulating member 5 to move slowly at the beginning stage so that the user will not be surprised due to a sudden start of the roller massaging apparatus 4 and will not receive sudden stimulus at the very beginning stages to thereby enable safety and a soft start.

The rotational direction of the massaging portion 2 at the beginning stage may be automatically controlled such that the massaging portion 2 rotates in the direction from the toe side to the heel side of the user's foot. This enables stagnant blood to be circulated and exchanged for fresh blood at the beginning stage of the massage pattern similar to the massage pattern of a professional massager.

The roller massaging apparatus 4 may include a massaging portion 2 having a plurality of bar-shaped rotatable rollers 1, wherein the rollers 1 are circumferentially mounted on the massaging portion 2 at a certain interval and detachably mounted to the massaging portion 2, and a driving mechanism 3 for rotating the massaging portion 2 around an axis thereof. According to the above-described structure of the roller massaging apparatus 4, different massaging effects can be obtained by changing the number of rollers 1 to be mounted on the massaging portion 2. Further, the fewer the number of rollers 1, the stronger the massage becomes because of the larger up-and-down movements to the portion to be massaged such as the sole of the user's foot. To the contrary, the larger the number of rollers 1, the softer the massage becomes because of the smaller up-and-down movements to the portion to be massaged such as the sole of the user's foot.

The roller massaging apparatus 4 may include a massaging portion 2 having a plurality of bar-shaped rotatable rollers 1, wherein the rollers 1 are circumferentially mounted on the massaging portion 2 at a certain interval and each roller 1 is different in shape, and a driving mechanism 3 for rotating the massaging portion 2 around an axis thereof. The massaging portion 2 has different shaped rollers 1 which give a different stimuli by changing the position of the rollers 1 when the massaging portion 2 rotates.

The roller massaging apparatus 4 may include a massaging portion 2 having a plurality of bar-shaped rotatable rollers 1, wherein the rollers 1 are circumferentially mounted on the massaging portion 2 at a certain interval and the massaging portion 2 is oval in cross-section, and a driving mechanism 3 for rotating the massaging portion 2 around an axis thereof. This enables the semi-minor axis portion of the roller 1 to massage the body of the user of the roller massaging apparatus 4 and also enables the semi-major axis portion of the roller 1 to massage the body of the user of the roller massaging apparatus 4. The semi-minor axis portion of the roller 1 gives a soft stimulus massage, whereas the semi-major axis portion of the roller 1 gives a strong stimulus massage.

Other objects and advantages of the present invention will become apparent from the description of the preferred embodiments, which may be modified in any manner without departing from the scope and spirit of the invention.

BRIEF EXPLANATION OF THE DRAWING FIGURES

FIG. 5 is an explanatory view of the roller massaging apparatus in use, wherein

FIG. 9 is a cross-sectional view of a stimulating protrusion, wherein

FIG. 10 is an explanatory view showing effective points for applying pressure on the sole of the user's foot, wherein

FIG. 19 is a partial perspective view showing the assembly of a roller.

FIGS. 20A and 20B are explanatory views showing different number of detachable rollers.

DETAILED DESCRIPTION OF THE PREFERRED EMBODIMENTS

Figure 1:
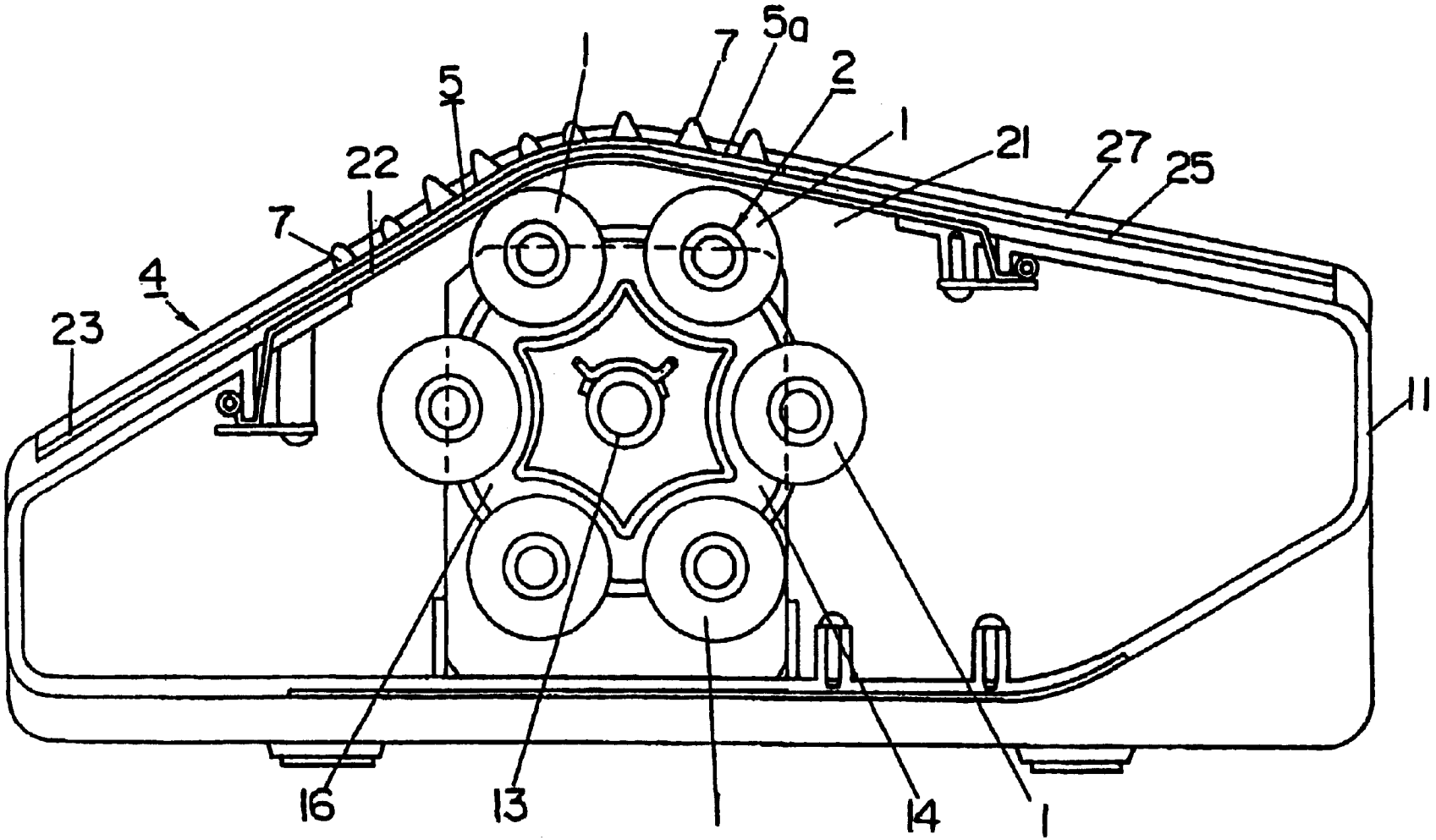
FIG. 1 is a cross-sectional side view of a roller massaging apparatus according to the present invention.

Preferred embodiments of a roller massaging apparatus 4, according to the present invention, will now be described in detail, with reference to the accompanying drawings.

FIGS. 1–10 show a first embodiment of a roller massaging apparatus according to the present invention. The roller massaging apparatus 4 has a basic construction including a housing 11, a massaging portion 2 and a driving mechanism 3. The massaging portion 2 and the driving mechanism 3 are disposed in the housing 11. The massaging portion 2 includes a plurality of bar-shaped rollers 1, each being rotatable about an axis thereof and circumferentially disposed at certain intervals. The driving mechanism 3 drives the massaging portion 2 about an axis thereof.

The massaging portion 2 will now be described in detail as follows.

Figure 2:
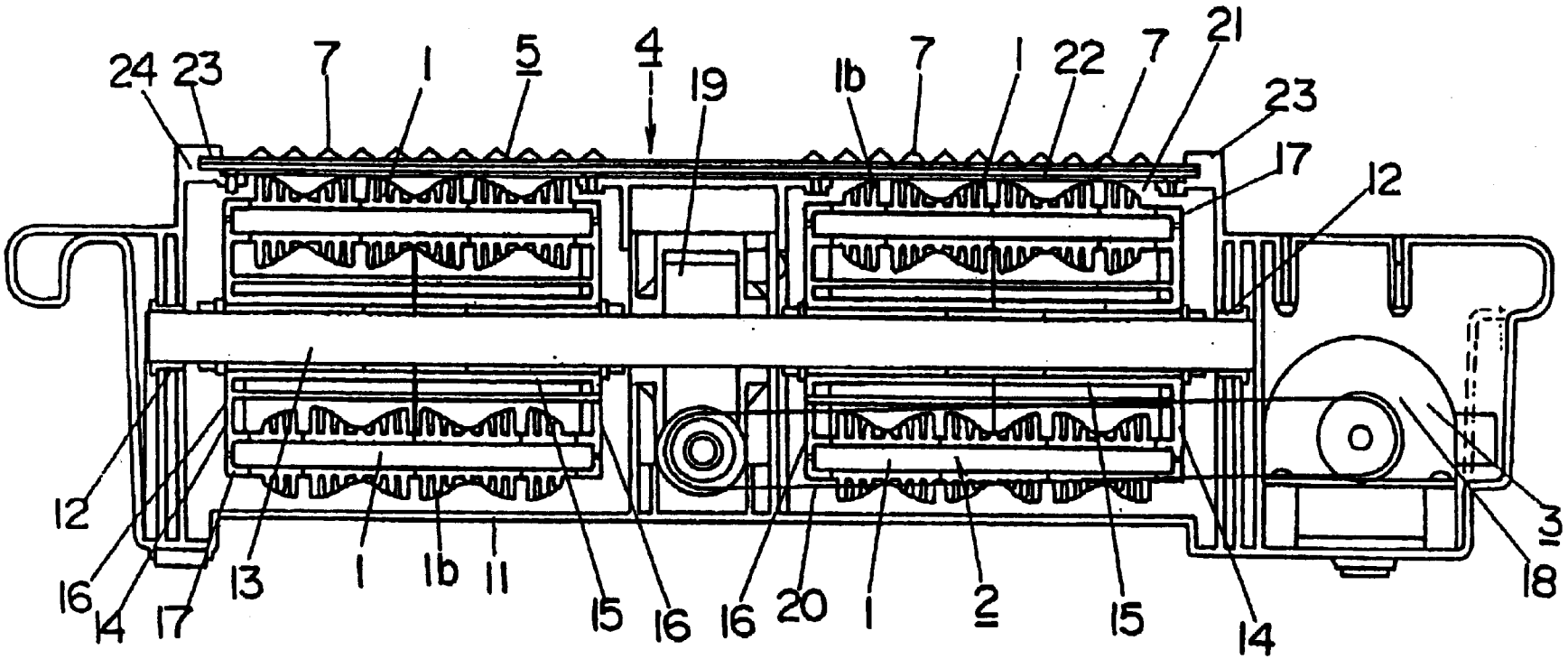
FIG. 2 is a cross-sectional front view of the roller massaging apparatus.
Figure 3:
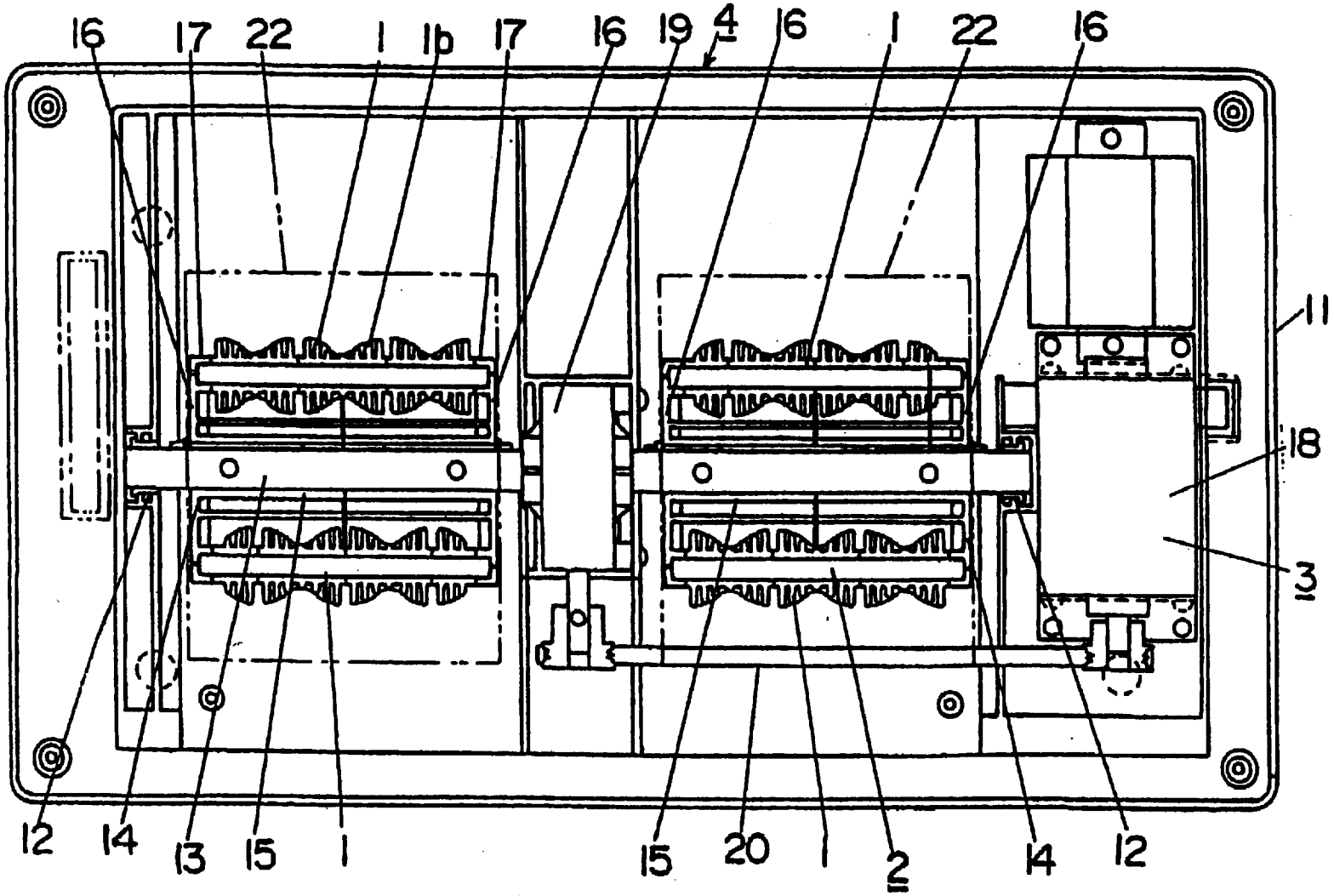
FIG. 3 is a cross-sectional top view of the roller massaging apparatus.
Figure 4:
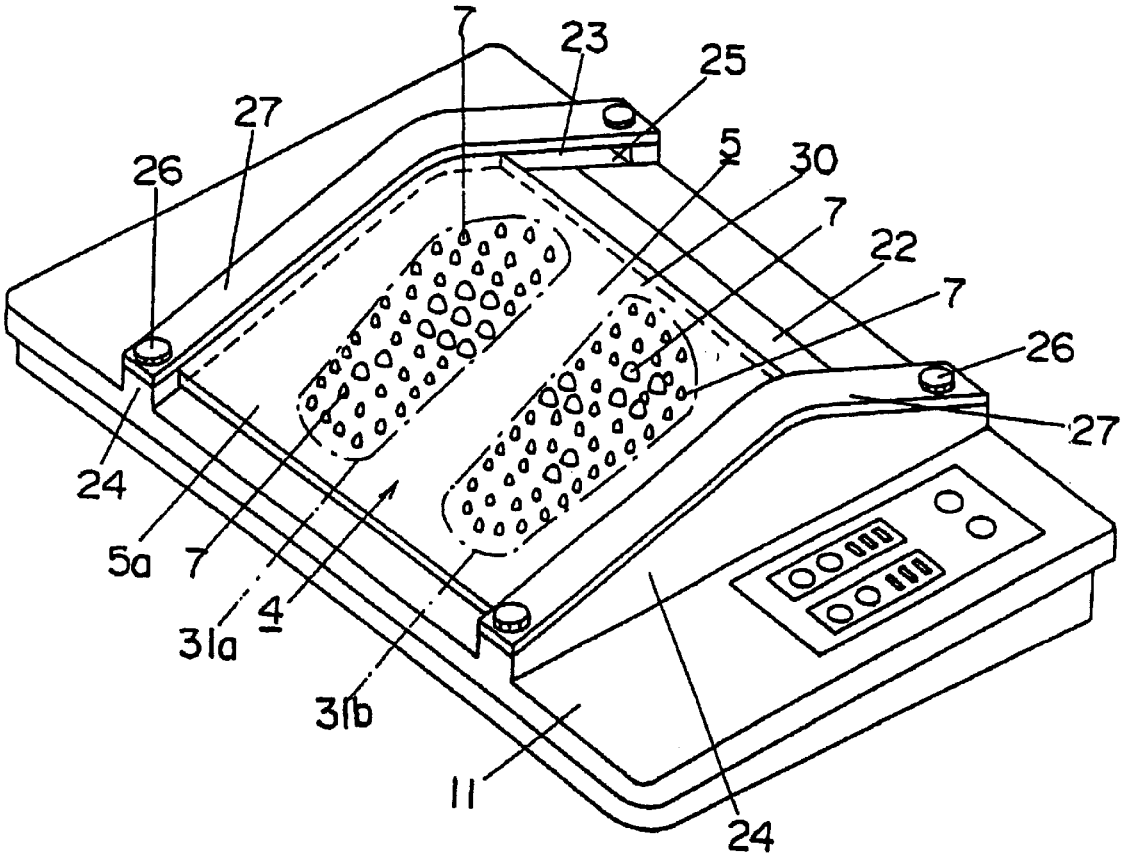
FIG. 4 is a perspective view of the roller massaging apparatus.

As shown in FIGS. 1–3, a shaft 13 is rotatably supported by bearing portions 12 formed in the housing 11. Rotators 14 are fixed on both sides of the shaft 13 and the shaft 13 is inserted into central cylindrical portions 15 of the rotators. The rotator 14 has end plates 16 at both ends of the central cylindrical portion 15. The end plates 16 each have roller receiving portions 17 formed at an outer peripheral portion thereof at a certain interval circumferentially around the outer periphery of the end plate 16. The rollers 1 are rotatably supported by corresponding roller receiving portions 17. Each roller 1 has a smooth, wave-like surface.

The housing 11 house a motor 18 and a reduction device 19 which constitute the driving mechanism 3. The rotation of the motor 18 is transmitted to the shaft 13, via a belt 20 and the reduction device 19, in order to rotate the shaft 13. The shaft 13, in turn, rotates the massaging portion 2 around the shaft 13.

An opening 21 is formed at an upper middle portion of the housing 11. The bar-shaped rollers 1 located at an upper portion of the massaging portion 2 are disposed in the opening 21. The rollers 1, which are disposed in the opening 21, work as a massager. The opening 21 is covered by a lower sheet 22 made of cloth or similar, so as to cover the massaging portion 2 with the ends of the sheet 22 fixed to the edge portions of the opening 21. The lower sheet 22 is upwardly pushed by the rotatable bar-shaped rollers 1.

A stimulating member 5, having stimulating means formed on a base sheet 5*a*, is disposed on the lower sheet 22 such that the rotatable bar-shaped rollers 1 push the stimulating member 5 upwardly via the lower sheet 22. Therefore, when a portion of user's body to be massaged, for example, the sole of the user's foot, is placed on the stimulating member 5, the stimulating member 5 is pushed upwardly by the rotating bar-shaped rollers 1, which massages the portion of the user's body to be massaged.

At least one of the massaging portion 2 and the stimulating member 5 may be movable against the other so as to change the mutual position of the massaging portion 2 with respect to the stimulating member 5. In the first embodiment, the stimulating member 5 is movable with respect to the massaging portion 2 so that changing the mutual position between the stimulating member 5 and the massaging portion 2 can cause different massaging effects.

In detail, in the first embodiment, rail portions 23 are formed along both sides of the opening 21, and the stimulating member 5 is slidably engaged with the rail portions 23 at both sides thereof such that the stimulating member 5 can slidably move along the rail portions 23. Thus, the fore-and-aft movements of the stimulating member 5 on the housing 11 can change the mutual position of the stimulating member 5 with respect to the massaging portion 2. In the first embodiment, the rail portions 23 are constituted by cutout portion 25 formed on inner surfaces of protrusions 24 formed on along both sides of the opening 21. On each protrusion 24, a cover 27 is detachably fixed by screws 26. The stimulating member 5 is assembled as follows. Both end portions of the stimulating member 5 are disposed in the cutout portion 25, when the covers 27 are detached from the protrusion 24 by removing the screws 26. Then, the covers 27 are fixed to the protrusions 24 by tightening the screws 26 so that the end portions of the stimulating member 5 cannot be moved upwardly so as to be pulled out from the cutout portions 25. The stimulating member 5 can be easily detached by removing the screws 26. This allows the stimulating member 5 to be exchanged, when it is worn down. This also allows the stimulating member 5 to be removed and replaced with a different one or removed for cleaning and reinstalled.

The stimulating member 5, which is movable along the rail portions 23, is stopped and held by a stopping means 6 at a certain position. In the variation of the first embodiment shown in FIGS. 6 and 7, the stopping means 6 includes a plurality of dented portions 28 formed on the side edges of the stimulating member 5 and a pair of elastic stopping members 29, such as plate springs, equipped on the facing sides of the protrusions 24. When the stimulating member 5 is moved along the rail portions 23, the elastic stopping members 29 are elastically engaged with the corresponding dented portions 28 so that the stimulating member 5 is stopped and held at a certain position.

Figure 5A:
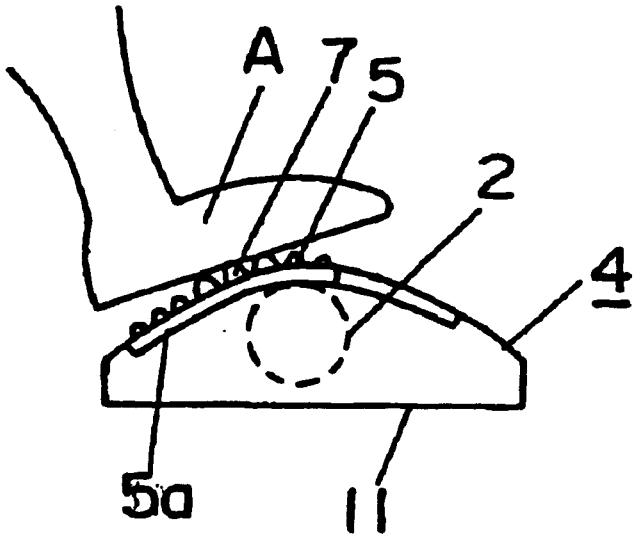
FIG. 5A shows the roller massaging apparatus in which the stimulating member is moved to the user's side.
Figure 5B:
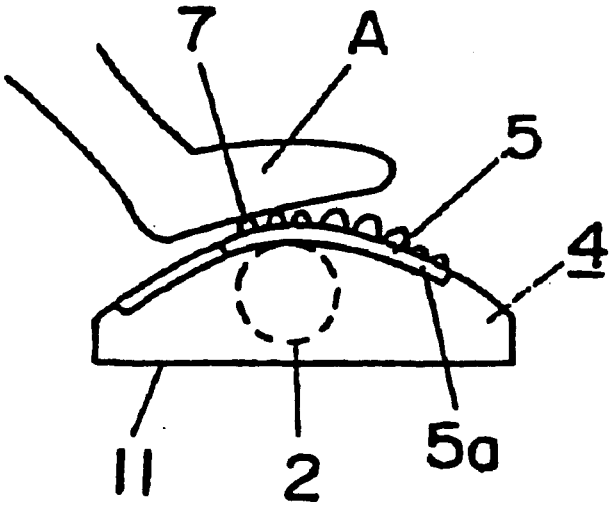
FIG. 5B shows the roller massaging apparatus in which the stimulating member is moved to the side opposite the user's side.
Figure 6:
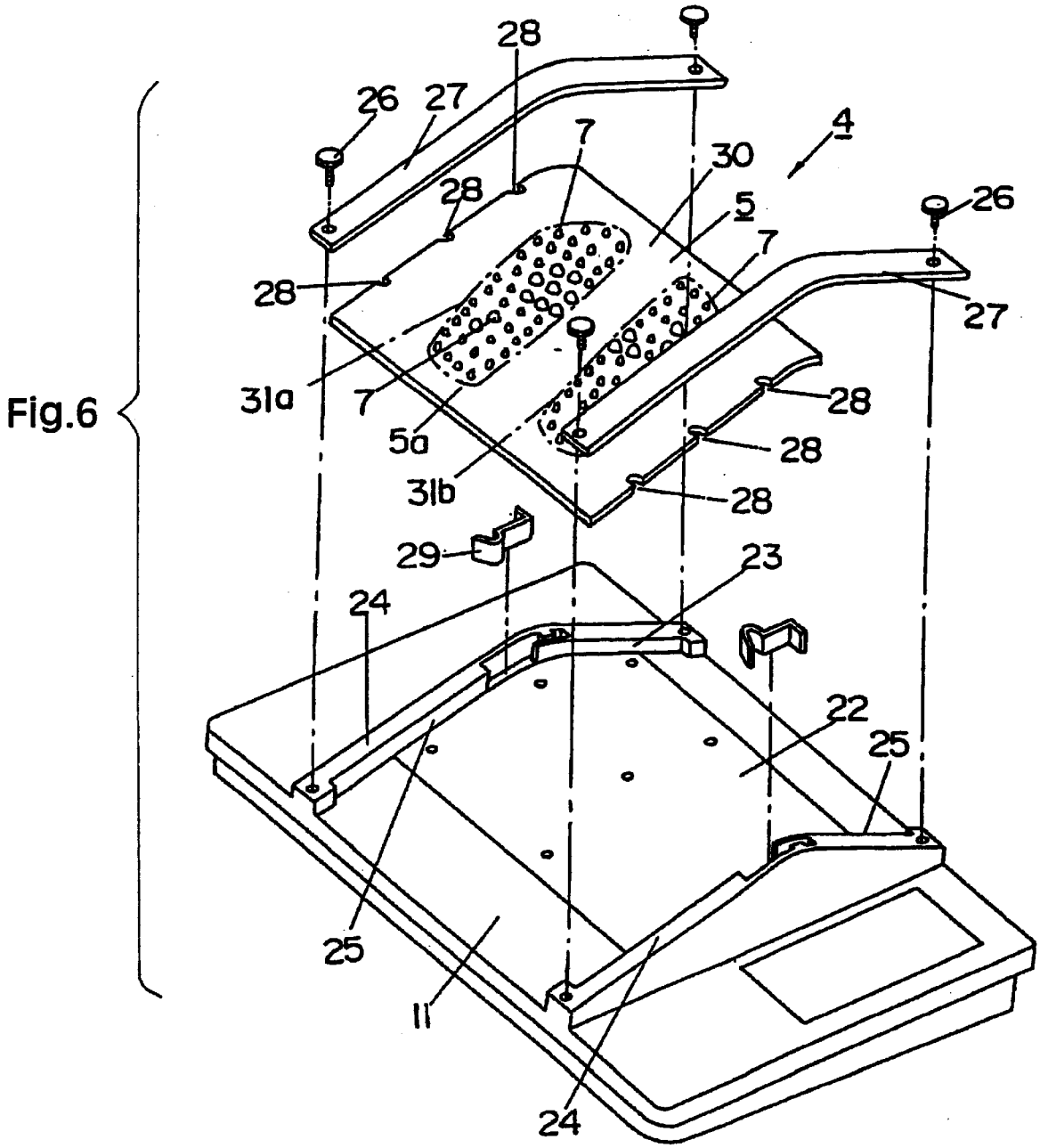
FIG. 6 is an exploded perspective view showing the roller massaging apparatus in a disassembled state.
Figure 7:
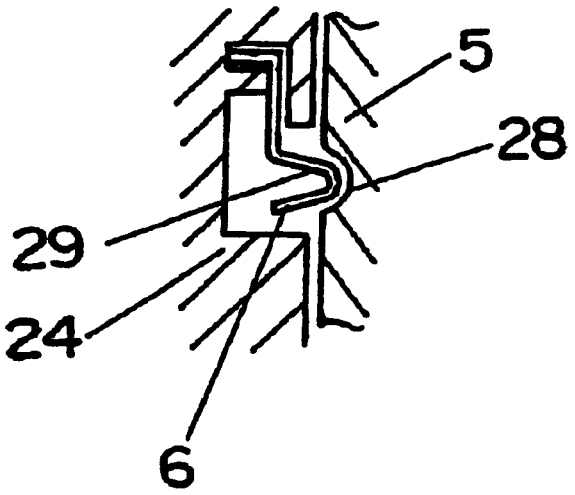
FIG. 7 is a cross-sectional view of a stopping member of the roller massaging apparatus.

As mentioned above, the stimulating member 5 includes a base sheet 5*a* and stimulators are formed on the base sheet 5*a*. In the first embodiment as shown in FIGS. 1–7, the stimulators are illustrated as stimulating protrusions 7. The stimulating protrusions 7 are formed on the stimulating member 5 and may be formed in such a manner that different groups having different stimulating protrusions 7 are formed on a plurality of regions. For example, a plurality of regions each having stimulating protrusions 7 of different sizes or heights are provided on the base sheet 5*a*. Moving the stimulating member 5 along the rail portion 23 changes the relative positional relationship between the stimulating member 5 and the massaging portion 2. For example, as shown in FIGS. 5A and 5B, the stimulus conditions of the part of human body to be massaged, i.e., the sole of the user's foot A in FIG. 5, are changed by the stimulating protrusions 7 which are different in shape and which are pushed up by the roller 1, enabling various kinds of massages different in the level stimulus.

Figure 8:
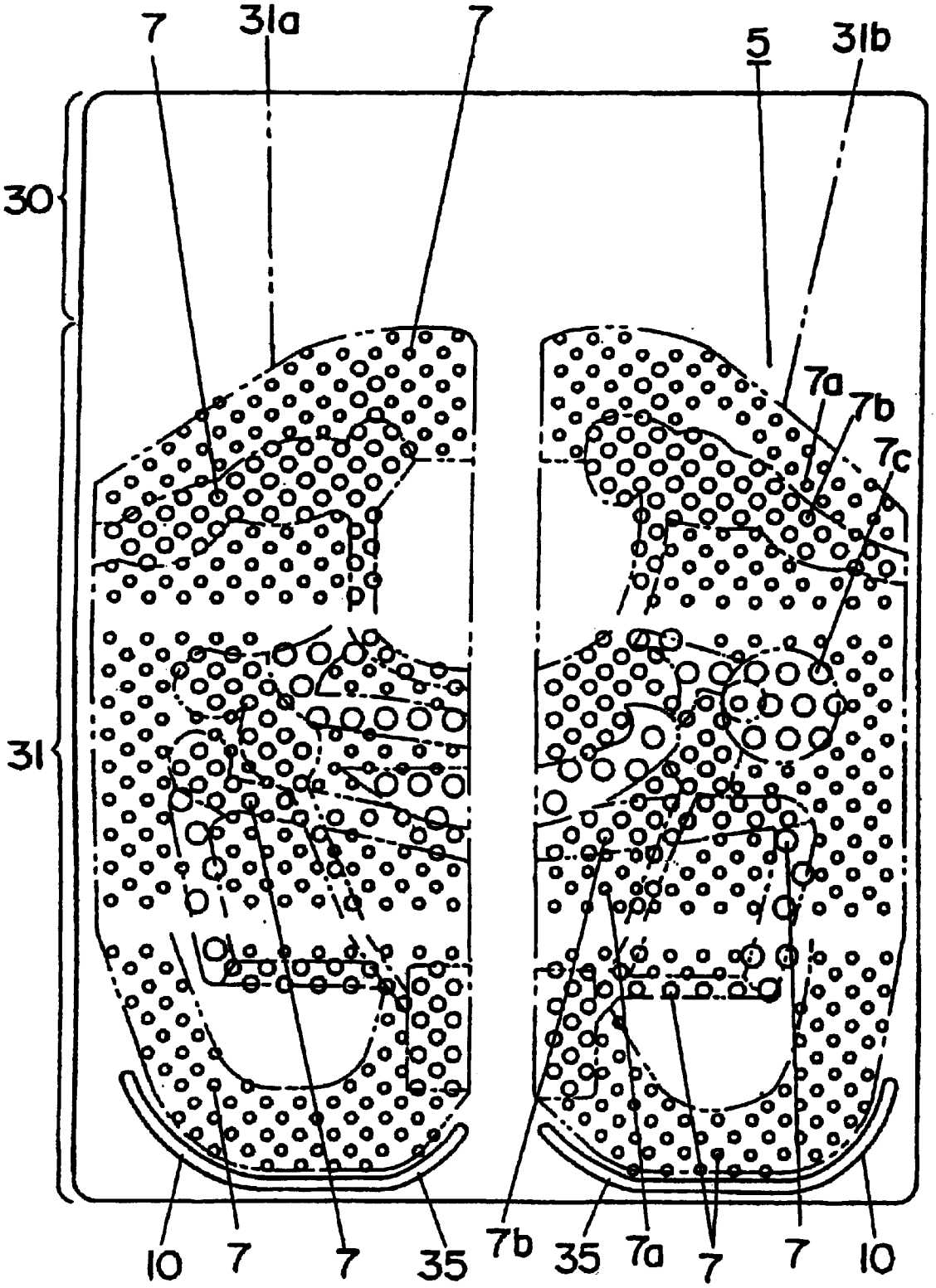
FIG. 8 is a plan view of the stimulating member.

As shown in FIG. 8, the stimulating member 5 is divided into two regions, namely, a region 30 with no stimulating protrusions 7 and a region 31 with stimulating protrusions 7. When the region 30 with no stimulating protrusions 7 is located on the roller 1 by moving the stimulating member 5 and a part of the body of the user to be massaged is placed on the region 30, the body part of the user can be massaged with weak stimulus by the region 30. In other words, forming the region 30 with no stimulating protrusions 7 and the region 31 with stimulating protrusions 7 on the stimulating member 5 enables the user to select a strong stimulus and a weak stimulus by changing the regions.

In the region 31 with stimulating protrusions 7, the stimulating protrusions 7 may be formed in foot-shape regions so as to obtain effective massaging effects on the sole of the foot of the user of the roller massaging apparatus 4. In the first embodiment shown in the attached drawings, the base sheet 5*a* is provided with a left-foot-shaped region 31*a* with stimulating protrusions 7 at a left side thereof, a right-foot-shaped region 31*b* with stimulating protrusions 7 at a right side thereof, and a region 30 with no stimulating protrusions 7 at an upper side thereof. In FIG. 8, the left-foot-shaped region 31*a* and the right-foot-shaped region 31*b* are shown by alternating long with two short dashed lines. The left-foot-region 31*a* has the stimulating protrusions 7 at points corresponding to the points to be massaged on the sole of the left foot of the user of the roller massaging apparatus 4, and the right-foot-region 31*b* has the stimulating protrusions 7 at points corresponding to the points to be massaged on the sole of the right foot of the user of the roller massaging apparatus 4.

Figure 10A:
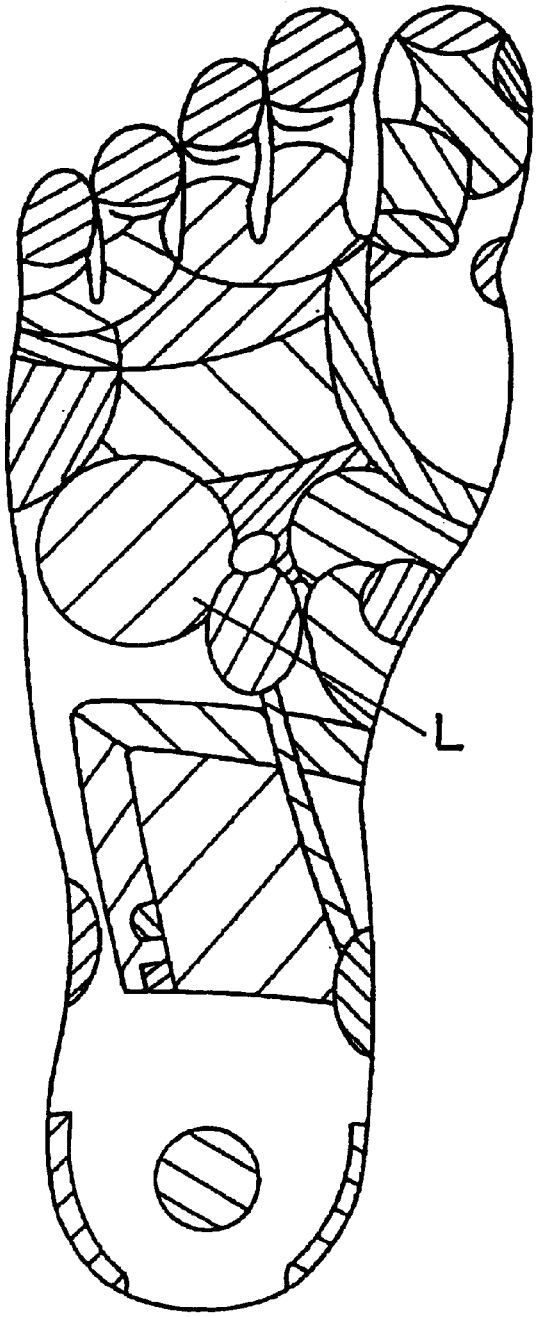
FIGS. 10A and 10B show effective points for applying pressure on the sole of the user's right foot and the sole of the user's left foot, respectively.
Figure 10B:
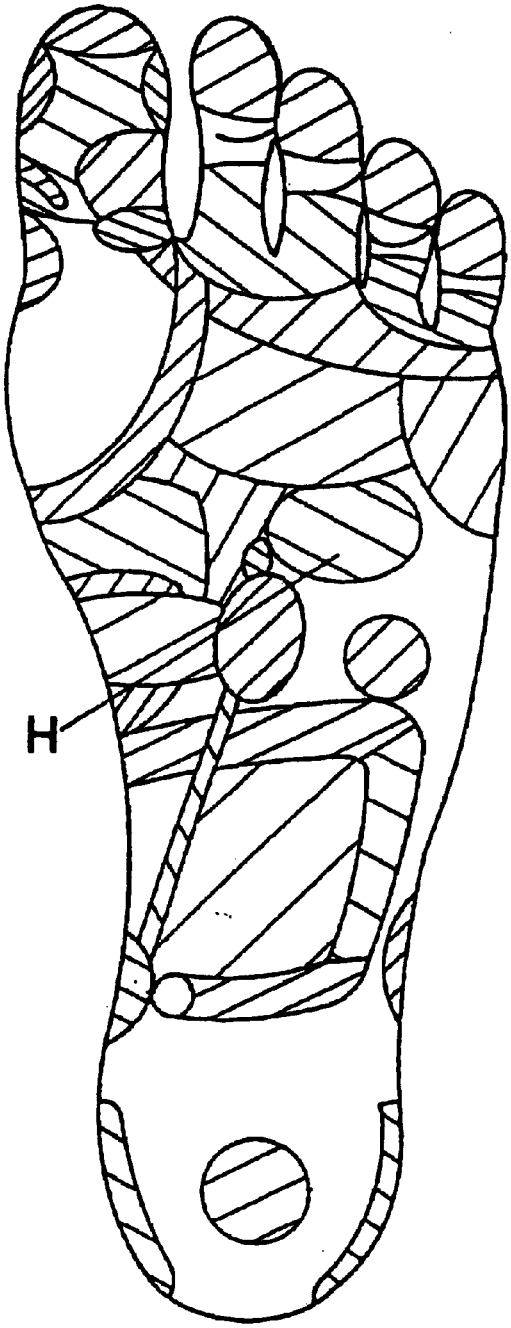

Though the sole of the foot of a user of the massaging apparatus 4 has many points to be massaged for stimulating each organ of the human body, the location of the points to be massaged on the sole of right foot and the location of the points on the sole of left foot are different from each other, as shown in FIGS. 10A and 10B. FIG. 10A and FIG. 10B show a distribution of the points on the sole of the right foot and the sole of left foot, respectively, of the user of the roller massaging apparatus 4. The location of the points to be massaged on the sole of right foot is different from the location of the points to be massaged on the sole of left foot. For example, the point H to be massaged for stimulating the heart is located at the arc of the left foot and the point L to be massaged for stimulating the liver is located at the arc of the right foot. In FIG. 10, regions having different hatching show different points to be massaged for stimulating different organs of the body of the user of the roller massaging apparatus 4.

Figure 9A:
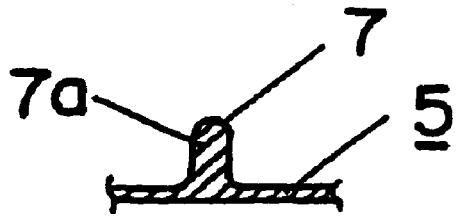
FIGS. 9A to 9C show different kinds of stimulating protrusions formed on the stimulating member.
Figure 9B:
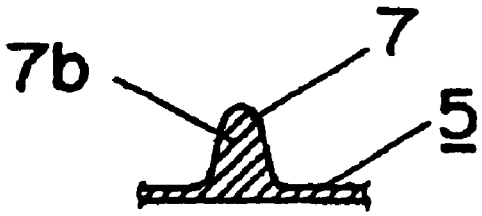
Figure 9C:
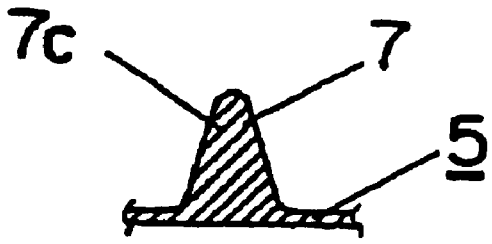

As shown in FIG. 8, the distribution of the stimulating protrusions 7 to be formed on the left-foot-shaped region 31*a* correspond to the points to be massaged on the sole of the left foot as shown in FIG. 10A and the distribution of stimulating protrusions 7 to be formed on the right-foot-shaped region 31*b* correspond to the points to be massaged on the sole of right foot as shown in FIG. 10B. Each stimulating protrusion 7, formed in the regions corresponding to the points to be massaged as shown in FIGS. 10A and 10B, is formed to have the most appropriate configuration for stimulating the points. In the embodiment shown in FIG. 8, both the left-foot-region 31*a* and the right-foot-region 31*b* are provided with three kinds of stimulating protrusions, namely, 7*a* as shown in FIG. 9A, 7*b* as shown in FIG. 9B, and 7*c* as shown in FIG. 9C, which are different in configuration and which are located so as to correspond to each of the points to be massaged as shown in FIGS. 10A and 10B. The stimulating protrusions 7*a*, 7*b*, and 7*c* having the most appropriate configuration to stimulate the corresponding point on the soles of the user's right and left foot are place in the appropriate positions in regions 31*a* and 31*b* to enable effective stimulus massage of the points of the soles of the user's right and left foot shown in FIGS. 10A and 10B.

A positioning means 10 is provided for positioning the user's foot on the stimulating member 5 to enable correct positioning of the points on the sole of the user's foot requiring stimulation as shown in FIGS. 10A and 10B with respect to the pattern of stimulating protrusions 7*a,* 7*b,* and 7*c* shown in FIG. 8. In the embodiment shown in FIG. 8, foot positioning protrusions 35 act as the positioning means 10 and are provided along the outer side of each heel portion of the left-foot-shaped region 31*a* and the right-foot-shaped region 31*b*. Each foot positioning protrusion 35 is formed in a U-shape, as shown in FIG. 8, so that the left foot or right foot can be correctly positioned on the left-foot-region 31*a* with stimulating protrusions 7 and on the right-foot-region 31*b* with stimulating protrusions 7, respectively, and can be held there. The foot positioning protrusion 35 may be provided on any one or both of the left-foot-region 31*a* with stimulating protrusions 7 and the right-foot-region 31*b* with stimulating protrusions 7.

The stimulating member 5 may be formed by elastic materials such as vinyl chloride, urethane, natural rubber or synthetic rubber. Forming the stimulating member 5 from elastic materials causes easy response of the stimulating member 5 corresponding to the stimulus of the rotation of the roller 1, which in turn more easily transmits the rotational stimulus of the roller 1 to the body of the user of the roller massaging apparatus 4 via the stimulating member 5, resulting in more effective stimulus massage.

Figure 11:
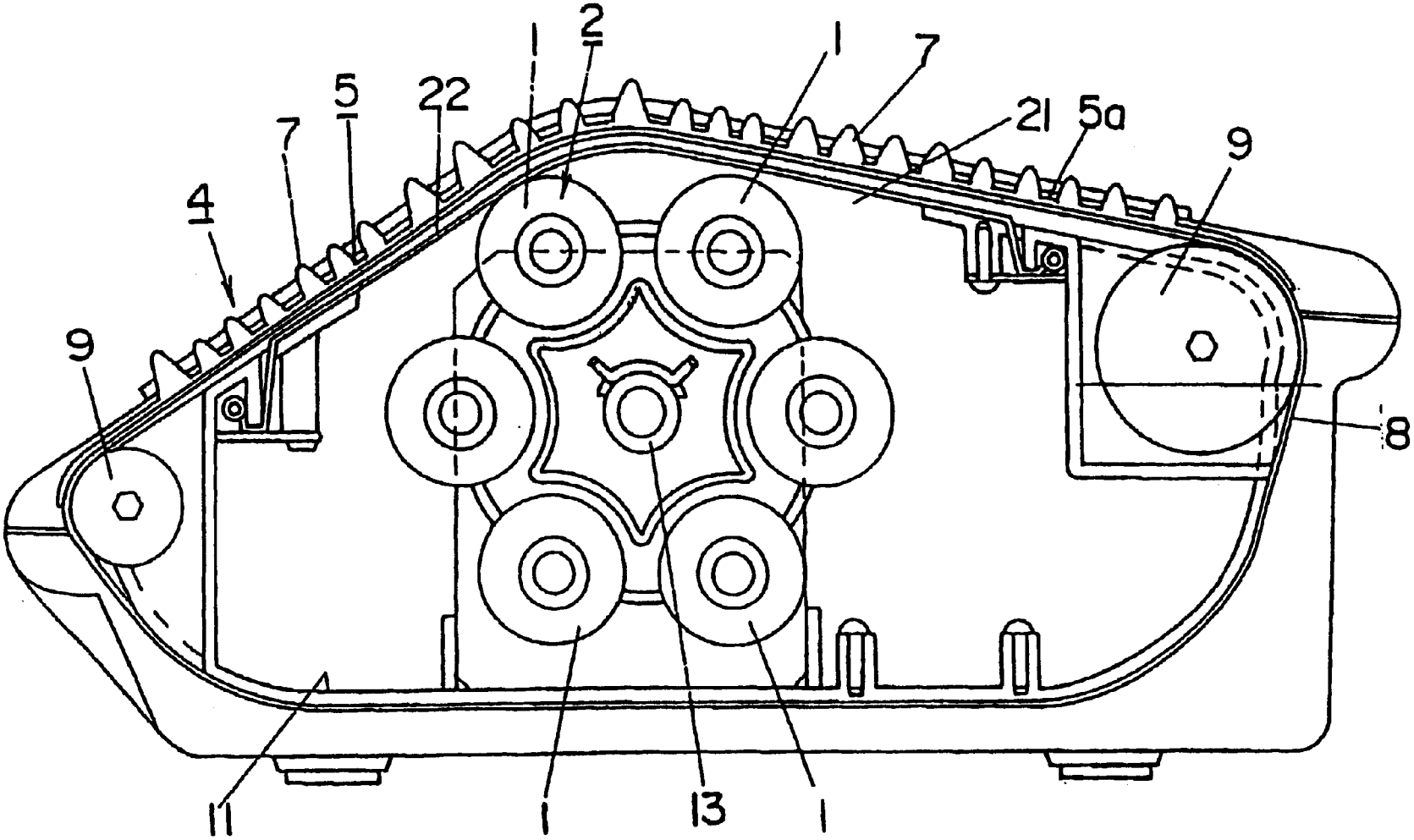
FIG. 11 is a cross-sectional side view of the second embodiment of the roller massaging apparatus according to the present invention.
Figure 12:
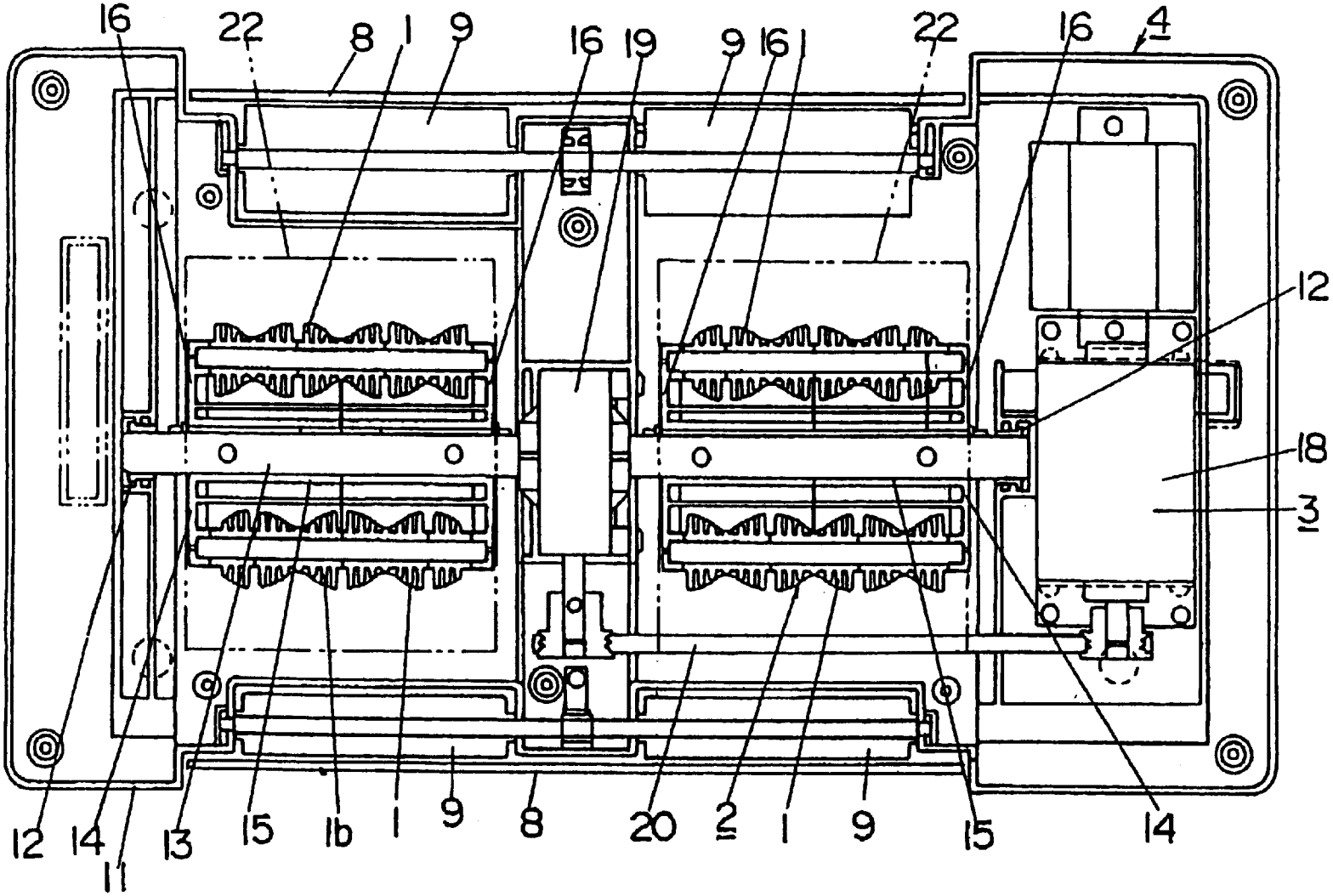
FIG. 12 is a cross-sectional top view of the roller massaging apparatus.

FIGS. 11 and 12 show the second embodiment of the present invention. In the second embodiment, the stimulating member 5 is fixed on a movable sheet 8 so that the stimulating member 5 can move together with the sheet 8 against the massaging portion 2. With respect to the second embodiment shown in FIGS. 11 and 12, the sheet 8 is formed to be endless and the stimulating member 5 is provided on about half the region of the outer surface of the sheet 8. The housing 11 is provided with sheet rotating rollers 9 in the fore-and-aft portions thereof. The sheet 8 is fitted around the housing 11 such that the sheet 8 covers the upper surface, the front surface, the lower surface and the rear surface with the sheet 8 put around the fore-and-aft rollers 9, enabling the stimulating member 5 to move together with the sheet 8. Providing rotatable sheet rotating rollers 9 and putting the sheet 8 around the rollers 9 allows a smooth movement of the sheet 8, i.e., the movement of the stimulating member 5. Therefore, for example, the stimulating member 5 can easily be positioned to the desired position by moving the stimulating member 5 forward or backward with the sole of the user's foot when in use.

For example, the stimulating member 5 can be fixed to the sheet 8 by integrally forming the stimulating member 5 together with a cloth as the sheet 8. If the stimulating member 5 is made of vinyl chloride or urethane, the stimulating member 5 is formed by laminating the vinyl chloride or urethane on the cloth as the sheet 8 and the laminating is done by a high-frequency welding technique to secure the vinyl chloride or urethane on the cloth. By fixing the stimulating member 5 on the movable sheet 8 such as a cloth as mentioned above, the stimulating member 5 can be moved smoothly. When the stimulating member 5 is made of elastic materials, the stimulating member 5 is hard to move because the elastic material has a large friction force. However, the sheet 8 made of a cloth with the stimulating means 5 can easily be moved due to the small friction force of the sheet 8. The sheet 8 may have a region with no stimulating members 5 and the same massaging effect can be obtained as the massaging effects obtained when using a sheet with no stimulating member 5. Thus, by positioning the region with no stimulating members 5 on the roller 1, it is not necessary to remove the stimulating member 5 from the sheet 8.

The stimulating member 5 may be detachably attached on the sheet 8 instead of being permanently fixed to the sheet 8. Attaching the stimulating member 5 to the sheet 8 may be achieved by using a flat-shaped fastener or similar. Thus, detachably attaching the stimulating member 5 to the sheet 8 enables the user to easily select the condition of the sheet 8 from a choice of a condition having the stimulating member 5 and a condition not having the stimulating member 8, in order to exchange the stimulating member 5 for any one of a variety of stimulating members 5 differing in stimulating level or in order to easily clean a dirty stimulating member 5.

Figure 13:
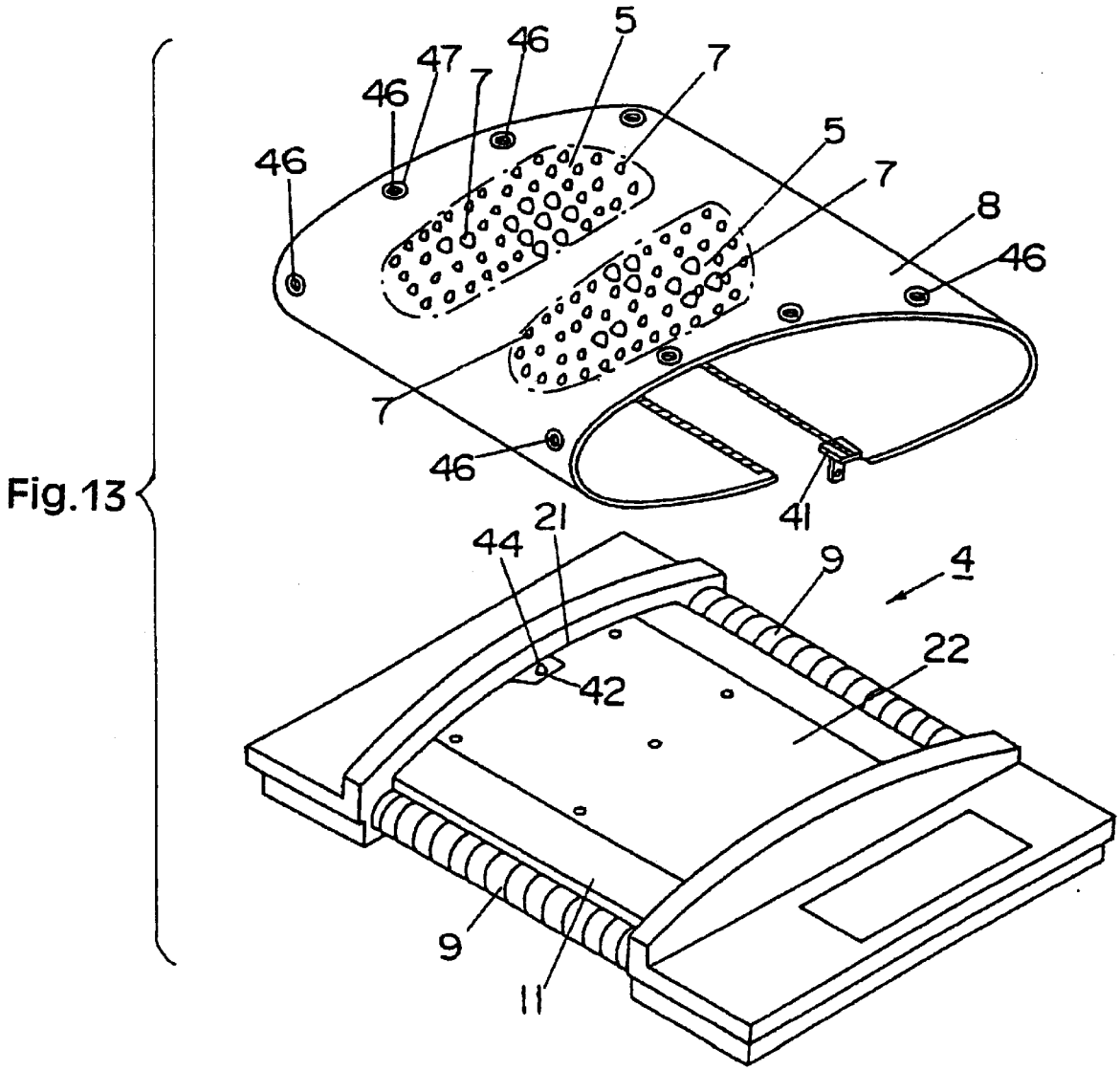
FIG. 13 is an exploded perspective view of a third embodiment of the roller massaging apparatus according to the present invention shown in a disassembled state.

In such a case that the stimulating member 5 is fixed on the sheet 8, the sheet 8 with the stimulating member 5 may be detachably mounted around the housing 11 of the roller massaging apparatus 4. FIG. 13 shows a variation of the second embodiment in which the sheet 8 with stimulating member 5 is detachably mounted around the housing 11 of the roller massaging apparatus 4. The sheet 8 is detachably connected at ends thereof by a fastener 41 to form an endless sheet. The endless sheet 8 is fitted around the housing 11 such that the sheet 8 covers the upper surface, the front surface, the lower surface and the rear surface of the housing 11 with the sheet 8 placed around the fore-and-aft rollers 9, thereby enabling the stimulating member 5 to move together with the sheet 8. In the variation of the second embodiment, the sheet 8 can be removed from the housing 11. Thus, the sheet 8 can be detached for cleaning the dirty sheet 8 and/or stimulating member 5, for exchanging the worn sheet 8, and also for exchanging the sheet 8 for a sheet 8' with different kinds of stimulating members 5. Furthermore, when the sheet 8 is detached from the housing 11, less massage stimulus is obtained via the lower sheet 22 when a portion of the user's body to be massaged is placed on the lower sheet 22 similar to a conventional roller massaging apparatus with no stimulating member.

Figure 14:
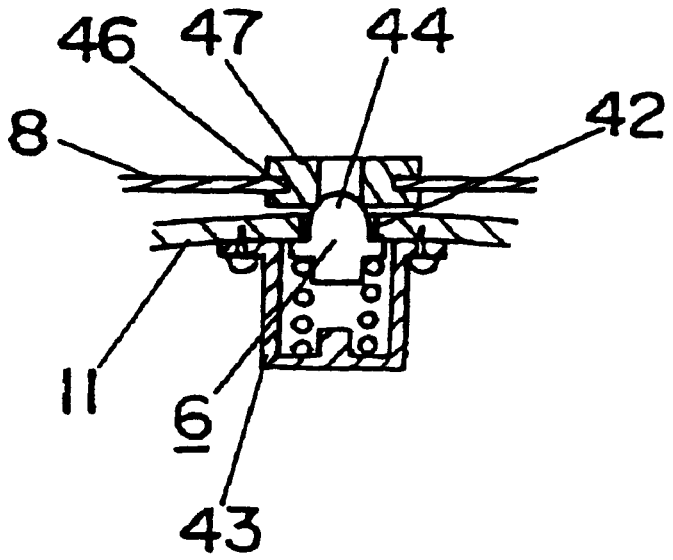
FIG. 14 is a cross-sectional view of a stopping member of the roller massaging apparatus.

In the movable sheet 8 with the stimulating member 5, stopping means can be provided so as to stop and hold the sheet 8 at a certain position. In FIGS. 13 and 14, a stopping means 6 is shown and will be explained as follows. At both edge portions around the opening 21 of the housing 11, engaging holes 42 and pin-holding cups 43 are provided, each of the pin-holding cups 43 being fixed to the edge portion underneath the engaging hole 42. An engaging pin 44 is mounted in each of the engaging holes 42 with the head portion of each pin 44 protruding through the engaging hole 42. The head portion of each pin 44 is urged upwardly by a spring mounted in the pin-holding cup 43 so as to move up and down. At both side portions of the sheet 8, engaging holes 46 are provided along the lateral side edges of the sheet 8. When the sheet 8 is moved, each engaging pin 44 is engaged with any one of the engaging holes 46 to stop and hold the sheet 8 at a desired position. Thus, massaging with a desired stimulus level can be performed. In the third embodiment shown in FIGS. 13 and 14, an eyelet 47 is provided at each engaging hole 46 so as to engage the engaging pin 44 therewith.

Figure 24:
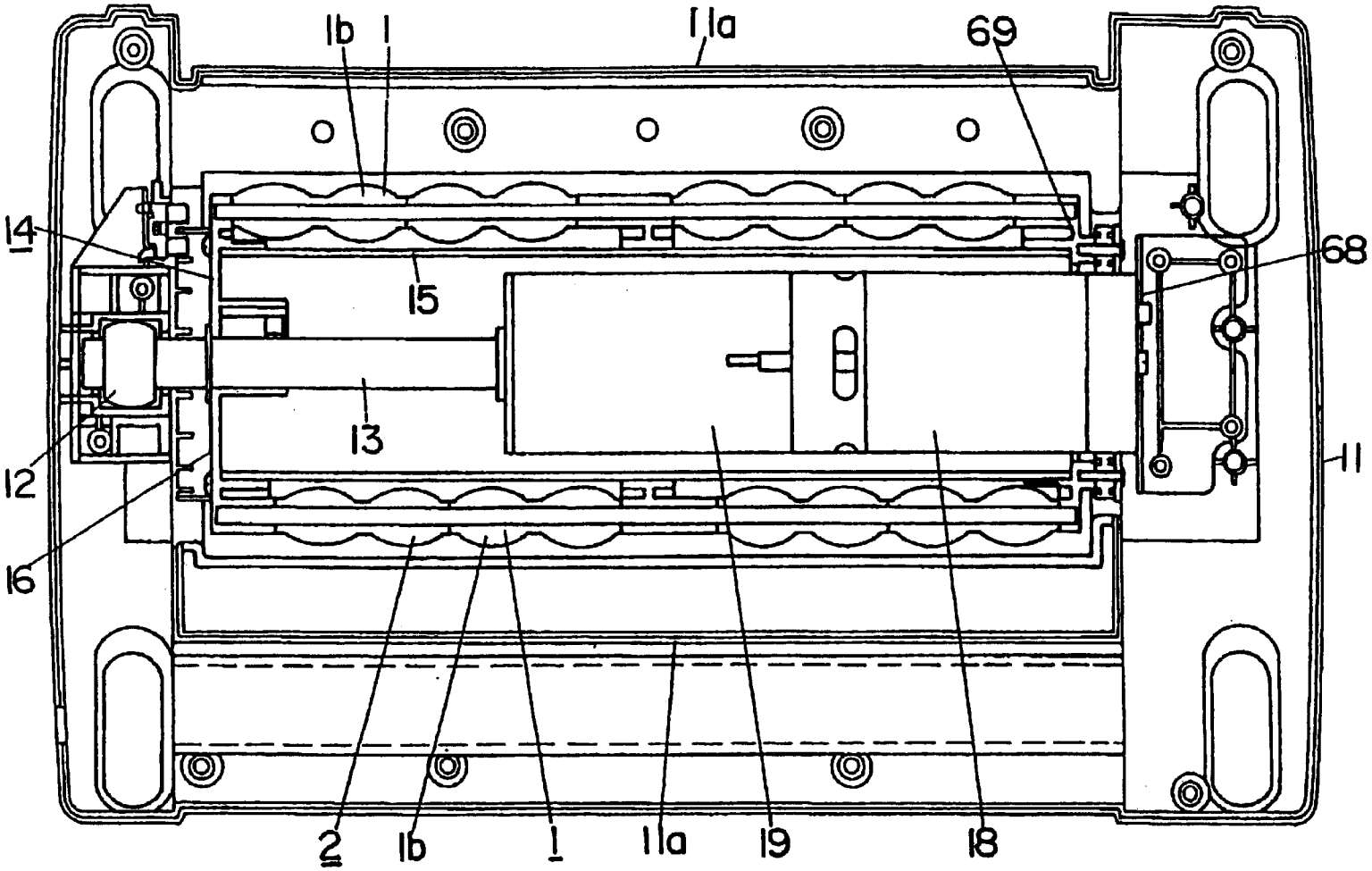
FIG. 24 is a cross-sectional plan view of the fifth embodiment.
Figure 25:
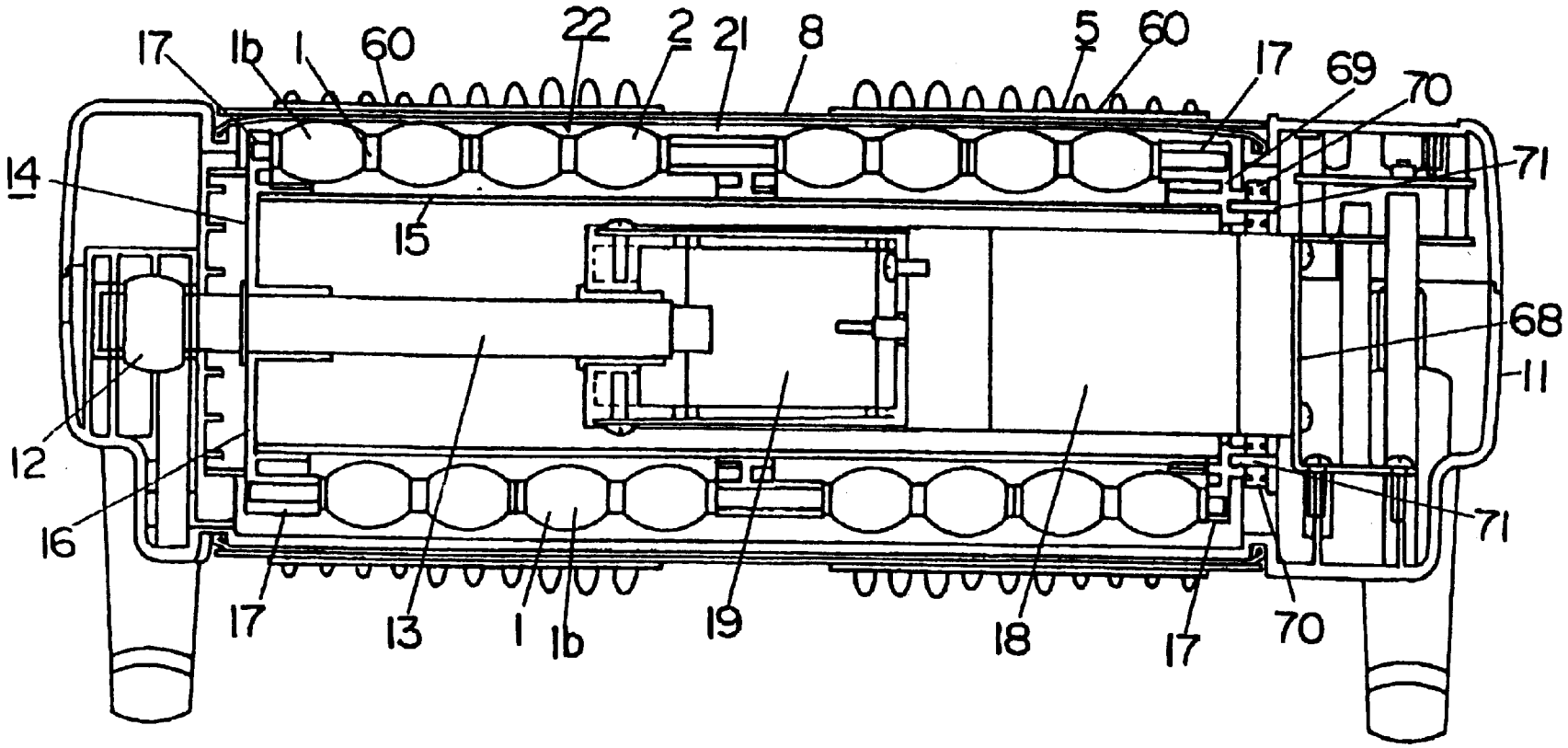
FIG. 25 is a cross-sectional front view of the fifth embodiment.
Figure 26:
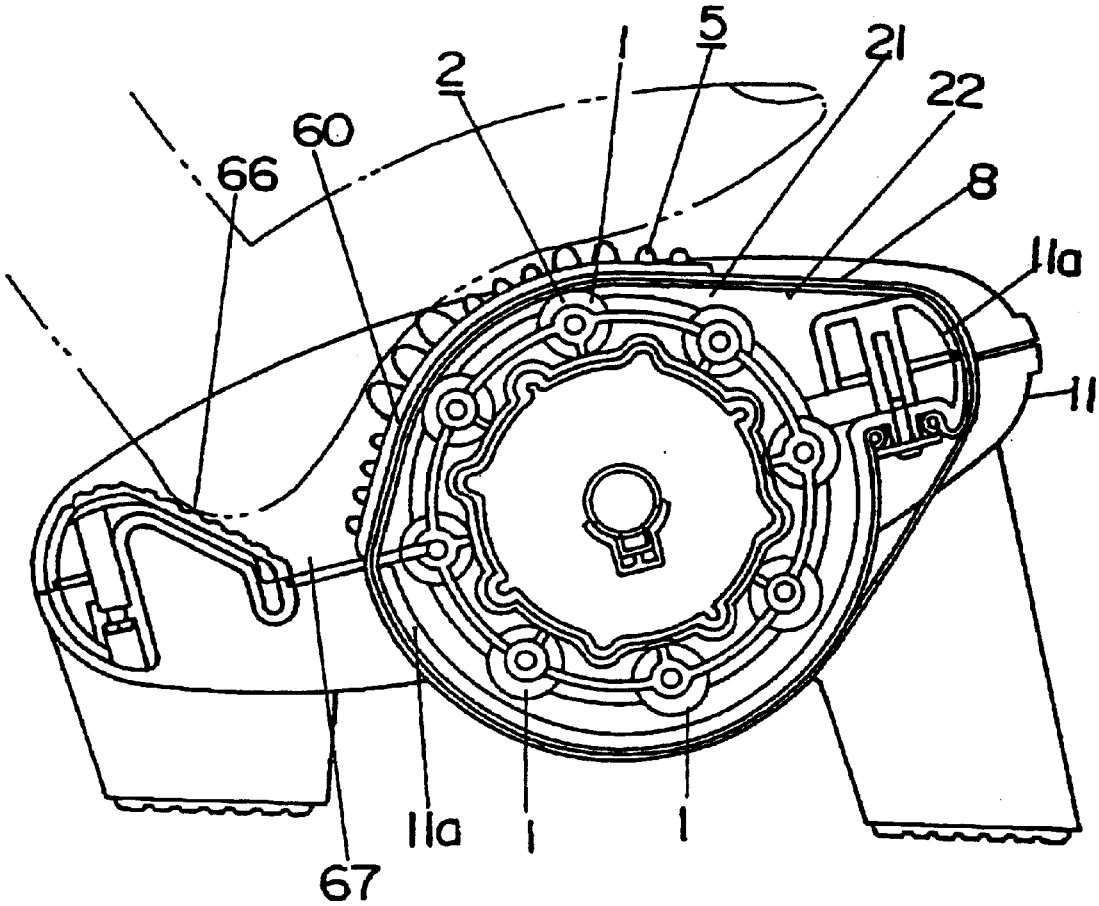
FIG. 26 is a cross-sectional side view of the fifth embodiment.

FIGS. 23–27 shows a fifth embodiment. In the fifth embodiment, the stimulating member 5 is fixed on the sheet 8, and the sheet 8 is allowed to move so as to change the position of the stimulating member 5 to the massaging portion 2. As shown in FIG. 26, the sheet 8 is formed in an endless manner. At the lower side and the front side of the housing 11, the sheet 8 is fitted on and movably supported by the arc-shaped portion 11*a*. At the opening 21 of the housing 11, the sheet 8 is supported by a massaging portion 2 facing underneath the opening 21 by way of the lower sheet 22. The stimulating member 5 may be attached on the sheet 8 in such a manner that an elastic material made of any one of vinyl chloride, natural rubber or synthetic rubber is fixed to the sheet by melt welding or bonding. The stimulating member 5 may be permanently or detachably fixed on the sheet 8. The stimulating member 5 has a plurality of massaging sheets 60 each having stimulating protrusions 7 thereon, to act as a stimulating means. The massaging sheets 60 are connected with one another by a connecting member 61. In the embodiment, a pair of massaging sheets 60 each shaped like the sole of the user's foot are formed on the both lateral sides of the sheet 8. The massaging sheets 60 are integrally connected with each other by the connecting member 61. The massaging sheet 60 and the connecting member 61 are fixed on the sheet 8. The massaging sheets 60 are formed on a part of the sheet 8 in the moving direction of the sheet 8 and therefore, the remaining part of the sheet 8 has no massaging sheet 60. As shown in FIG. 28, which is a unfolded view of the sheet 8, massaging sheets 60 are provided at the right and left parts of the upper half portion of the sheet 8, but there is not a massaging sheet 60 provided at the lower half portion 63 thereof. A stimulating member moving portion 62 is connected to the stimulating member 5 so as to be located at the lateral side edge portion of the sheet 8. The stimulating member moving portion 62 is integrally connected at the upper edge to the lower outer edge of the foot-shaped massaging sheet 60. In other words, the stimulating member 5 includes a pair of right and left massaging sheets 60, a pair of upper and lower connecting members 61 and a pair of stimulating member moving portions 62. The stimulating member 5 may be fixedly attached on the sheet 8, and also may be detachably attached on the sheet 8 via a flat-shaped fastener or similar. As shown in the attached drawings of this embodiment, the connecting members 61 connect the right and left massaging sheets 60 at the fore-and-aft portions of the moving direction of the stimulating member 5. The connecting member 61 may be a member which connects the corresponding side edges of the massaging sheets 60 along almost a whole length thereof, or may be three or more members. In such a case that both the massaging sheets 60 are connected by the connecting members 61 at the fore-and-aft portions of the moving direction of the stimulating member 5, the massaging sheets 60 can effectively be pushed up by the roller 1 without being disturbed by the connecting members 61, i.e., without being stretched by the connecting members 61. Further, connecting both the massaging sheets 60 with the connecting members 61 at the fore-and-aft portions of the moving direction of the stimulating member 5 can clearly distinguish the massaging sheet 60 from the connecting member 61, thereby making the foot placing area clear. The stimulating member moving portion 62 may be formed to have uneven surfaces so as to prevent slipping.

Figure 27A:
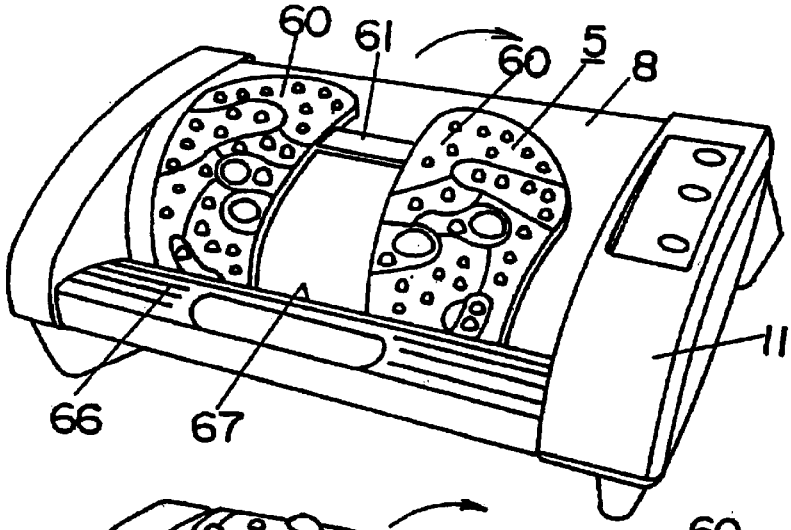
FIGS. 27A to 27C are explanatory views of the fifth embodiment showing movement of the sheet.
Figure 27B:
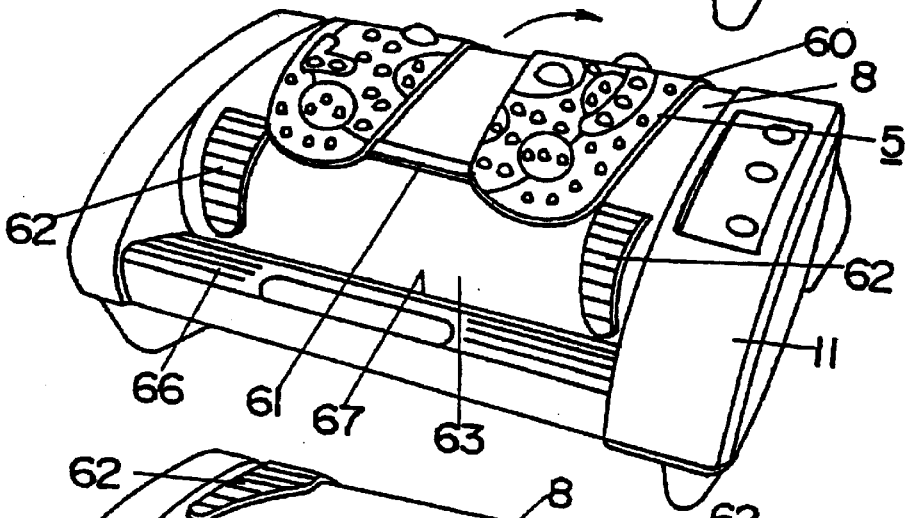

In the fifth embodiment, two different kinds of massaging positions, i.e., a position wherein the stimulating members 5 are located above the massage portion 2 as shown in FIG. 27A and a position wherein a portion with no massaging sheet 60 is located above the massage portion 2 as shown in FIG. 27B, can be selected by moving the sheet 8 with stimulating members 5. The sheet 5 can be moved manually by hand or the sheet 5 can also be moved by the user's feet by pushing forward the massaging sheets 60 from a state shown in FIG. 27A to a state shown in FIG. 27B and finally to the state shown in FIG. 27C. Moving the sheet 8 from the state shown in FIG. 27B to the state shown in FIG. 27C can be performed by placing the user's feet on the first and second massaging sheets 60 to move the first and second massaging sheets 60 past the stimulating member moving portions 62 and pushing forward the stimulating member moving portions 62 with a first of the massaging sheet 60 that is pushed forward with the user's foot to move the sheet 8. Since both the first and second massaging sheets 60 are connected by the connecting members 61, the second massaging sheet 60 can be moved correctly and smoothly and the sheet 8 between the massaging sheets 60 can be prevented from slacking.

In a state that a portion 63 having no massaging sheets 60 is located above the roller 1, the stimulating member moving portions 62 are located above the roller 1. However, as the moving portions 62 are located at both side end portions of the sheet 8, the central portion of the sheet 8 having no massaging sheets 60 is disposed to thereby enable massaging of the sole of the foot of the user by the portion 63 having no massaging sheets 60 as is shown in FIG. 27C.

Figure 27C:
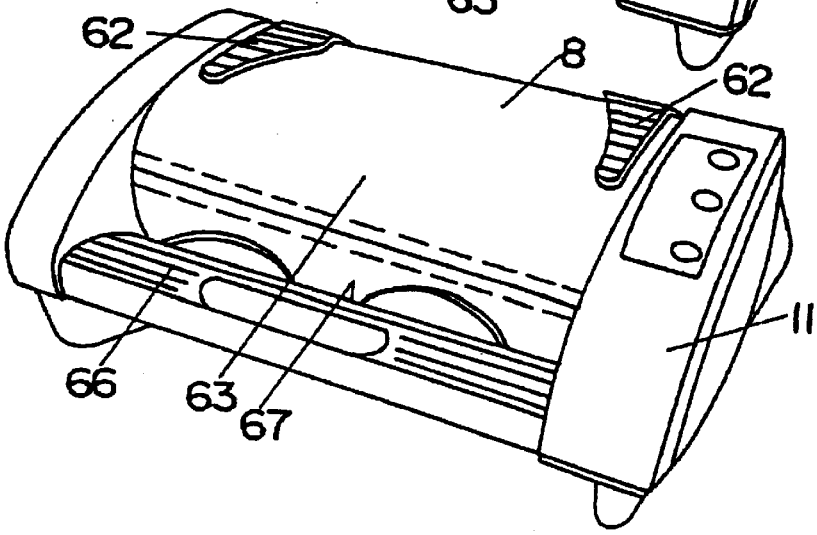
Figure 28:
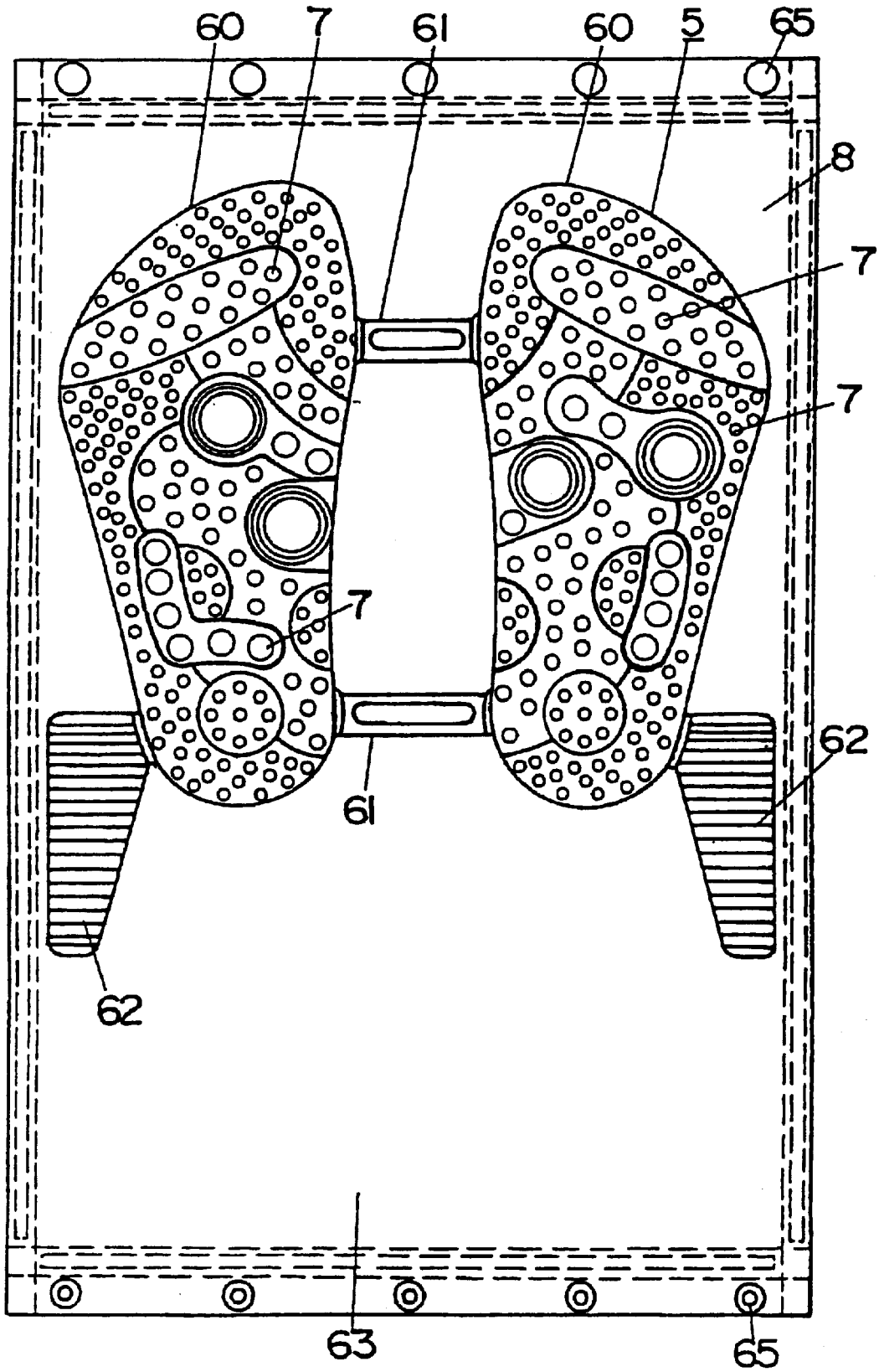
FIG. 28 is a plan view of the unfolded sheet having stimulating members used in the fifth embodiment.

Changing the position of the sheet 8 from the position shown in FIG. 27C to the position shown in FIG. 27A can be done by pushing forward or rearward the moving portions 62 by means of the user's foot so as to move the sheet 8. When the sheet 8 is moved half of the way from the position shown in FIG. 27C to the position shown in FIG. 27A (in other word, to the position shown in FIG. 27B), the portion of the user's foot that is being used to push may be moved from the stimulating member moving portion 62 to the massaging sheet 60 so as to move the sheet 8 to the position shown in FIG. 27A.

Providing the stimulating member moving portions 62 for moving the stimulating member 5 which is positioned above the massaging portion 2 enables the easy movement of the stimulating member 5 from the position where the stimulating member 5 is not positioned above the roller 1 to the position where the stimulating member 5 is positioned above the massaging portion 2 by means of pushing on the stimulating member moving portions 62.

In the fifth embodiment, the sheet 8 is detachably connected with each other at longitudinal ends thereof to form an endless sheet by means of snap fasteners 65 equipped at the ends as shown in FIG. 28. However, such snap fasteners 65 may be replaced by a zipper 41 as disclosed in the aforementioned embodiment, or another known detachable fastening means.

As shown in the fifth embodiment in FIGS. 23–27, the housing 11 is provided with a heel supporting portion 66 at a front end thereof. As shown in FIG. 26, the heel supporting portion 66 is used to support the user's heel when in use. By placing the user's heel on the heel supporting portion 66, a stable massage of the user's foot can be performed in a stable posture. A gap 67 is formed between the heel supporting portion 66 and the rear end of the arc-shaped portion 11*a* so as to pass through the sheet 8 therebetween when rotating.

As shown in the fifth embodiment in FIGS. 24 and 25, the motor 18, which constitutes the driving mechanism 3, and the reduction device 19 are both equipped in the housing 11. The motor 18 is fixed to the inside of the housing 11 at a first end thereof by a bracket 68. An output shaft 13 protrudes from the reduction device 19 connected to the second end of the motor 18 in a direction opposite to the motor 18. The leading end of the shaft 13 is rotatably supported by the bearing portion 12 mounted in the housing 11. The rotator 14 is provided with an end plate 16 at a first end thereof and with a ring-shaped member 69 at a second end thereof. At outer peripheral portions of the end plate 16 and the ring-shaped member 69, roller receiving portions 17 are provided at a certain interval. Bar-shaped rollers 1 are rotatably supported by the corresponding roller receiving portions 17. Each roller 1 is formed to have an uneven surface. The central cylindrical portion 15 mounted in the rotator 14 is disposed so as to cover the motor 18, the reduction device 19 and the shaft 13, and is fixed to the shaft 13 by means of the end plate 16. The ring-shaped member 69 mounted at the second end of the rotator 14 has a plurality of rotatable rollers 70 fixed by shafts 71 along the circumferential direction of the ring-shaped member 69 so as to rotate on the outer surface of the round-shaped motor 18.

As is clear from the above-described structure, the rotator 14 is supported at a first end by the shaft 13, which is rotatably supported by the bearing portion 12 mounted in the housing 11, and is supported at the second end by the outer surface of the motor 18. This allows for the omitting of one of the bearing portions 14, resulting in compactness.

Further, a plurality of rollers 70 roll on the outer surface of the motor 18 as a bearing surface and the load of the roller 1 is supported by the outer surface of the motor 18 in sequence, thereby resulting in small wear and long-life.

In the above embodiments, either the stimulating member 5 or the sheet 8 having the stimulating member 5 thereon is moved manually by operation of the user's hand or foot. However, either the stimulating member 5 or the sheet 8 having the stimulating member 5 thereon may be moved by a driving means such as a motor 48.

Figure 15:
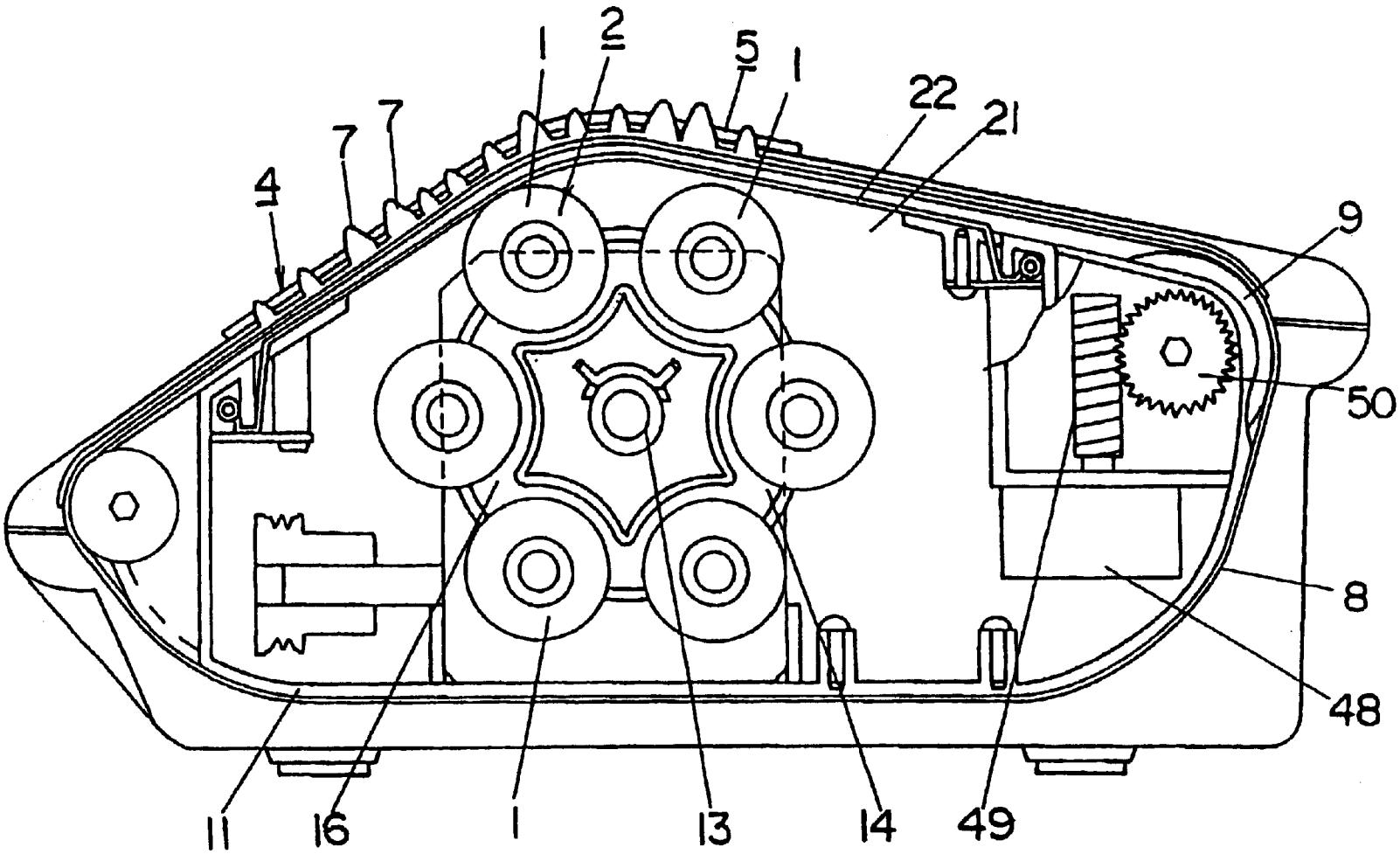
FIG. 15 is a cross-sectional side view of the fourth embodiment of a roller massaging apparatus according to the present invention.

FIG. 15 shows a fourth embodiment in which the sheet 8 having the stimulating member 5 thereon is driven by a driving means such as a motor 48. In the fourth embodiment, a motor 48 for driving the sheet 8 is installed in the housing 11. The rotation of the motor 48 is transmitted to the sheet rotating roller 9 by means of a worm gear 49 and a gear 50, which in turn automatically drives the sheet 8 having the stimulating member 5 thereon which has been put around the sheet rotating roller 9. The sheet rotating roller 9 is driven by the motor 48 and has lateral grooves in its surface so as to prevent the sheet 8 from slipping by means of the increased friction between the surface and the sheet 8. The motor 48 may be driven by a pulse motor or similar at a certain angle in accordance with signals so as to move the sheet 8 to a predetermined position. This allows the stimulating member 5 which is fixed on the sheet 8 to move to a predetermined position by controlling the switch of the pulse motor, which results in easy positioning of the stimulating member 5 and effective massage.

Figure 16:
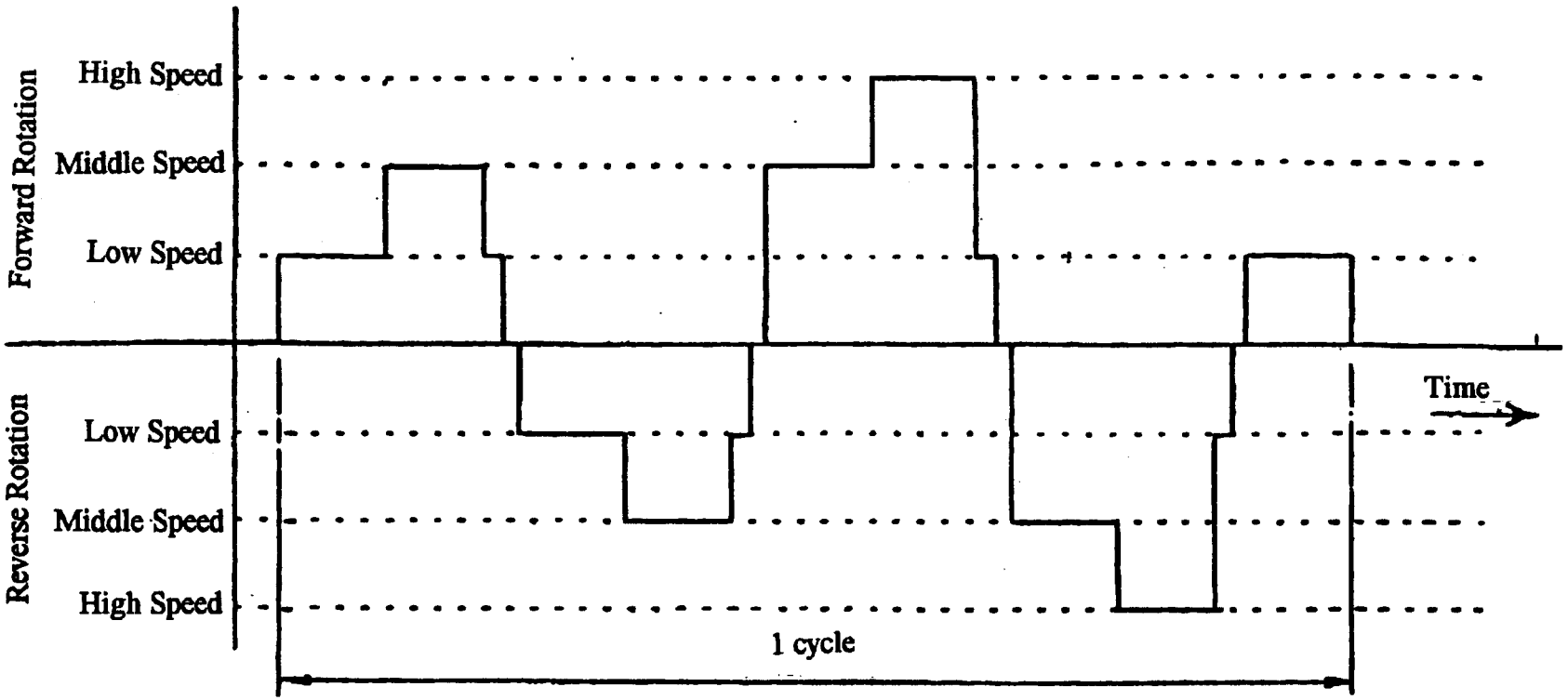
FIG. 16 is an example of a timing chart showing that the roller rotation is automatically controlled toward the predetermined velocity and direction.
Figure 17:
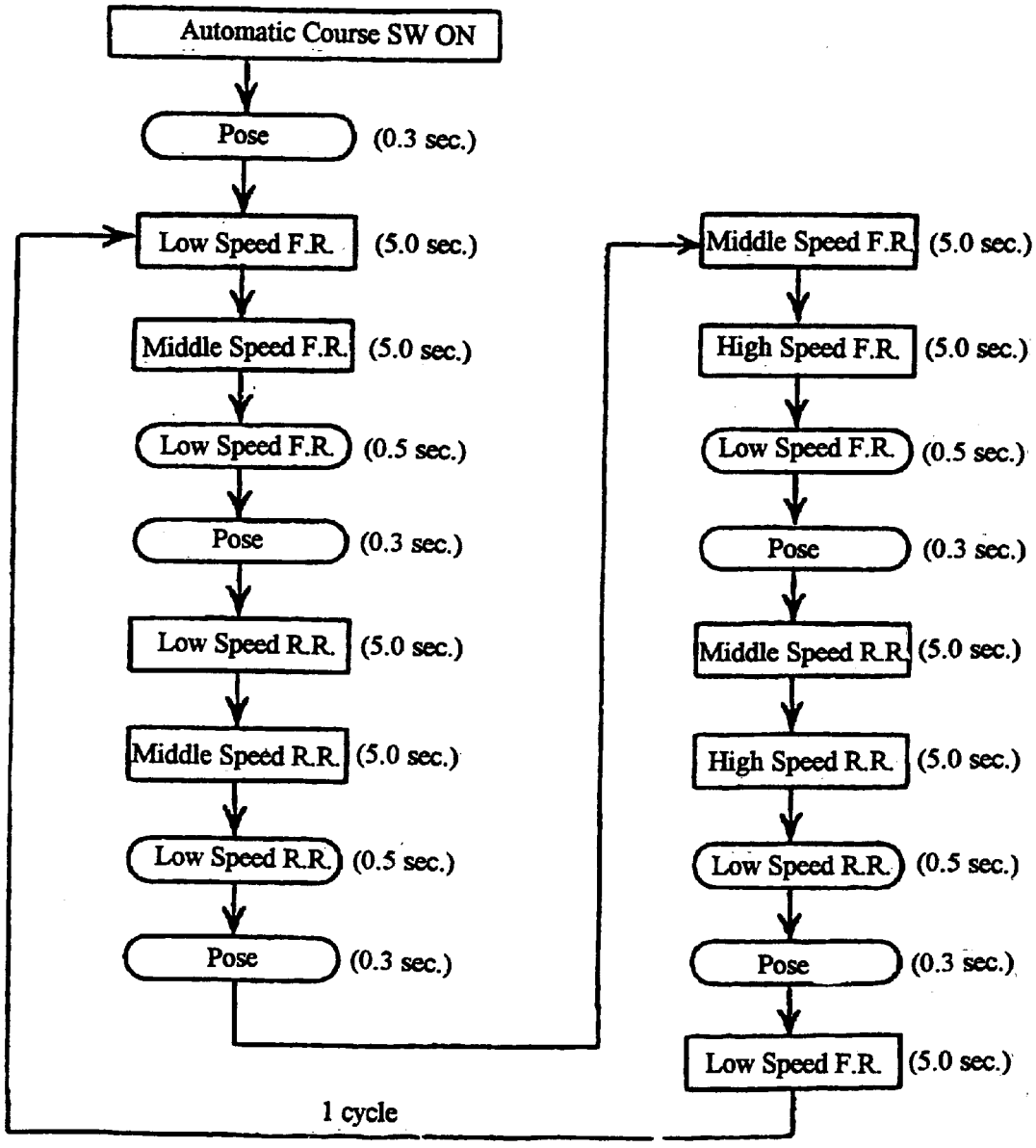
FIG. 17 is a flow chart showing the operation of the automatic control.

In the above-described first through fifth embodiments of the roller massaging apparatus 4 according to the present invention, the massaging portion 2 is rotated around the shaft by the driving mechanism 3. The rotational movement of the massaging portion 2, which is driven by the driving mechanism 3, may be controlled by a controller such that the rotational speed and/or rotational direction of the roller 1 is automatically changed so as to follow the massaging pattern of a professional massager. In detail, the rotational speed and/or rotational direction of the motor 18 in the driving mechanism 3 is controlled by a control means including electric circuits with a microcomputer having a program such that the rotational movement of the massaging portion 2, i.e., the rotational speed and the rotational direction of the massaging portion 2, is automatically controlled so as to follow predetermined rotational patterns. FIGS. 16 and 17 show a fourth embodiment in which the rotational movement of the massaging portion 2, having a circumferentially arranged plurality of rollers 1, is automatically controlled by a control means. In the fourth embodiment shown in FIGS. 16 and 17, there are six different rotational patterns, namely, a low speed forward rotation, a middle speed forward rotation, a high speed forward rotation, a low speed reverse rotation, a middle speed reverse rotation, and a high speed reverse rotation. As shown in FIGS. 16 and 17, when the automatic course switch is turned on, after a pause for a certain period of time, a one cycle pattern is automatically repeated by the control means, as follows: a low speed forward rotation, a middle speed forward rotation, a low speed forward rotation, a pause for a certain period of time, a low speed reverse rotation, a middle speed reverse rotation, a low speed reverse rotation, a pause for a certain period of time, a middle speed forward rotation, a high speed forward rotation, a low speed forward rotation, a pause for a certain period of time, a middle speed reverse rotation, a high speed reverse rotation, a low speed reverse rotation, a pause for a certain period of time, a low speed forward rotation. By automatically controlling the rotational speed and rotational direction of the massaging portion 2 having a circumferentially disposed plurality of rollers 1, the massaging stimulus which resembles the massaging patterns of a professional massager can be obtained. The rotational pattern is not limited to the above-described, and other patterns may be employed.

In the embodiment in which either the stimulating member 5 or the sheet 8 having the stimulating member 5 thereon is driven by the driving means such as a motor 48, the movement of either the stimulating member 5 or the sheet 8 having the stimulating member 5 thereon may be controlled by a control means so as to automatically change the speed and the position as predetermined. In detail, the control means includes electric circuits having a micro-computer which is controlled by a predetermined program. The stimulating member 5 or the sheet 8 having the stimulating member 5 thereon is moved automatically in accordance with the predetermined program. By placing the sole of the user's foot on the stimulating member 5 when in use, the sole of the user's foot is moved together with the stimulating member 5, thereby automatically massaging the sole of the user's foot in the whole area or in the limited area defined by the movement of the stimulating member 5. Automatically changing the position of the stimulating member 5 by the control means enables the massaging stimulus which resembles the massaging patterns of a professional massager to be obtained, thereby enhancing the massaging effects. The combination of changing the position of the stimulating member 5 and automatically controlling the speed and direction of the roller 1, further makes causes the resemblance to the massaging patterns of a professional massager to be increased and thereby the further enhancing of the massaging effects.

In the beginning stage of the rotation of the roller 1, the roller 1 may be controlled by a control means such that the roller 1 starts at the predetermined low speed. In detail, the motor 18 in the driving mechanism 3 is controlled by the control means such that in the very beginning stage the motor 18 is driven at a low speed for a short time period, preferably for three to five seconds, and thereafter the motor 18 is driven in accordance with the predetermined patterns. This slow start driving in the very beginning stage may be applied not only to a manual operation but also to the automatic operation detailed above with respect to FIGS. 16 and 17. As the stimulating member 5 begins to move slowly at the beginning stage, the user will not be surprised due to a sudden start and will not receive sudden stimulus at the very beginning stage, thereby enabling safety and a soft start.

Figure 18A:
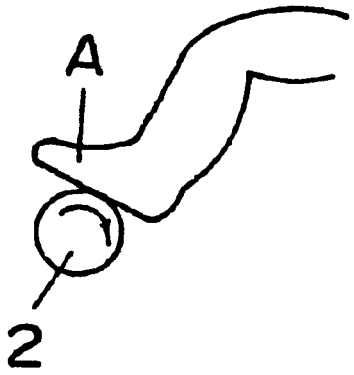
FIGS. 18A and 18B are explanatory views each showing the rotational direction of the massage portion.
Figure 18B:
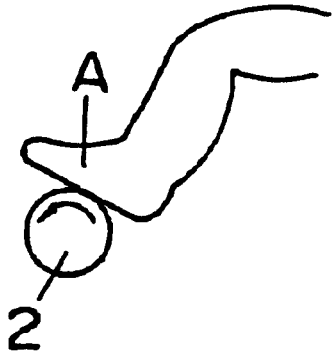

In such a case that the motor 18 in the driving mechanism 3 is automatically controlled by the control means in accordance with the predetermined programs, the rotational direction of the motor 18 at the beginning stage is automatically controlled such that the motor 18 rotates in the direction from the toe side to the heel side. According to a professional massager's massaging pattern for massaging the sole of the massagee's foot, the basic concept of the massage at the beginning of the massage is to circulate the stagnant or unoxygenated blood in the foot so as to exchange it for fresh or oxygenated blood. Thus, at the beginning of the massaging the sole of the massagee's foot, the massage is performed from the toe side far from the heart toward the heel side nearer the heart so as to pump the stagnant blood into the heart. In the present invention, as shown in FIG. 18A, in order to follow the above-described professional massaging patterns, the rotational direction of the massaging portion 2, having a circumferentially arranged plurality of rollers 1 at the beginning of the massaging, is set to rotate from the toe side of the sole toward the heel side thereof. In the fourth embodiment shown in FIGS. 16 and 17 in which the rotational direction and speed is automatically controlled by the control means in accordance with predetermined programs, the forward rotation of the massaging portion 2, having a circumferentially arranged plurality of rollers 1, corresponds to the rotation from the toe side of the sole toward the heel side as shown in FIG. 18A, the reverse rotation thereof being the rotation from the heel side of the sole toward the top side. As a result, according to the present invention, the stagnant blood in the foot can be circulated to be exchanged for a fresh blood at the beginning stage of the massage similar to the massaging patterns of a professional massager.

A plurality of bar-shaped rollers 1 may be detachably mounted to the rotator 14. FIG. 19 shows a fourth embodiment in which a plurality of rollers 1 are detachably attached to the rotator 14. In detail, in the fourth embodiment shown in FIG. 19, the bar-shaped roller 1 has a penetrating hole at the axial center, and a roller shaft 51 is inserted in the penetrating hole so as to allow the roller 1 to be able to rotate around the shaft 51. The roller shaft 51 has bent portions 52 at both ends thereof. The roller 1 is detachably mounted to the rotator 14 by detachably inserting the bent portions 52 at regular intervals into corresponding engaging holes 53 formed on the outer surface of the end plates 16. Thus, different massaging effects can be obtained by changing the number of rollers 1 to be mounted to the rotator 14. For example, as shown in FIG. 19, sixteen engaging holes 53 are formed on the outer periphery of each end plate 16 at regular intervals. FIG. 20A shows an embodiment in which sixteen rollers 1 are mounted by using all of the engaging holes 53. FIG. 20B shows another embodiment in which eight rollers 1 are mounted by using every other engaging holes 53, i.e., total eight engaging holes 53. Thus, the smaller the number of rollers 1 used, the stronger the massaging effect becomes because of the larger up-and-down movements of the portion to be massaged such as the sole of the user's foot. To the contrary, the larger the number of roller 1 used, the softer the massage effect becomes because of the smaller up-and-down movements of the portion to be massaged such as the sole of the user's foot. As a result, the fourth embodiment shown in FIG. 20A can produce soft massaging effects and the fourth embodiment shown in FIG. 20B can produce strong massaging effects. The number of the rollers 1 is not limited to the embodiments shown in FIGS. 20A and 20B. Any number of rollers 1, for example, four rollers or two rollers may be used. By detachably attaching the rollers 1, the rollers 1 can be exchanged for different kinds of rollers and also worn rollers 1 can be replaced with new rollers 1.

Figure 21:
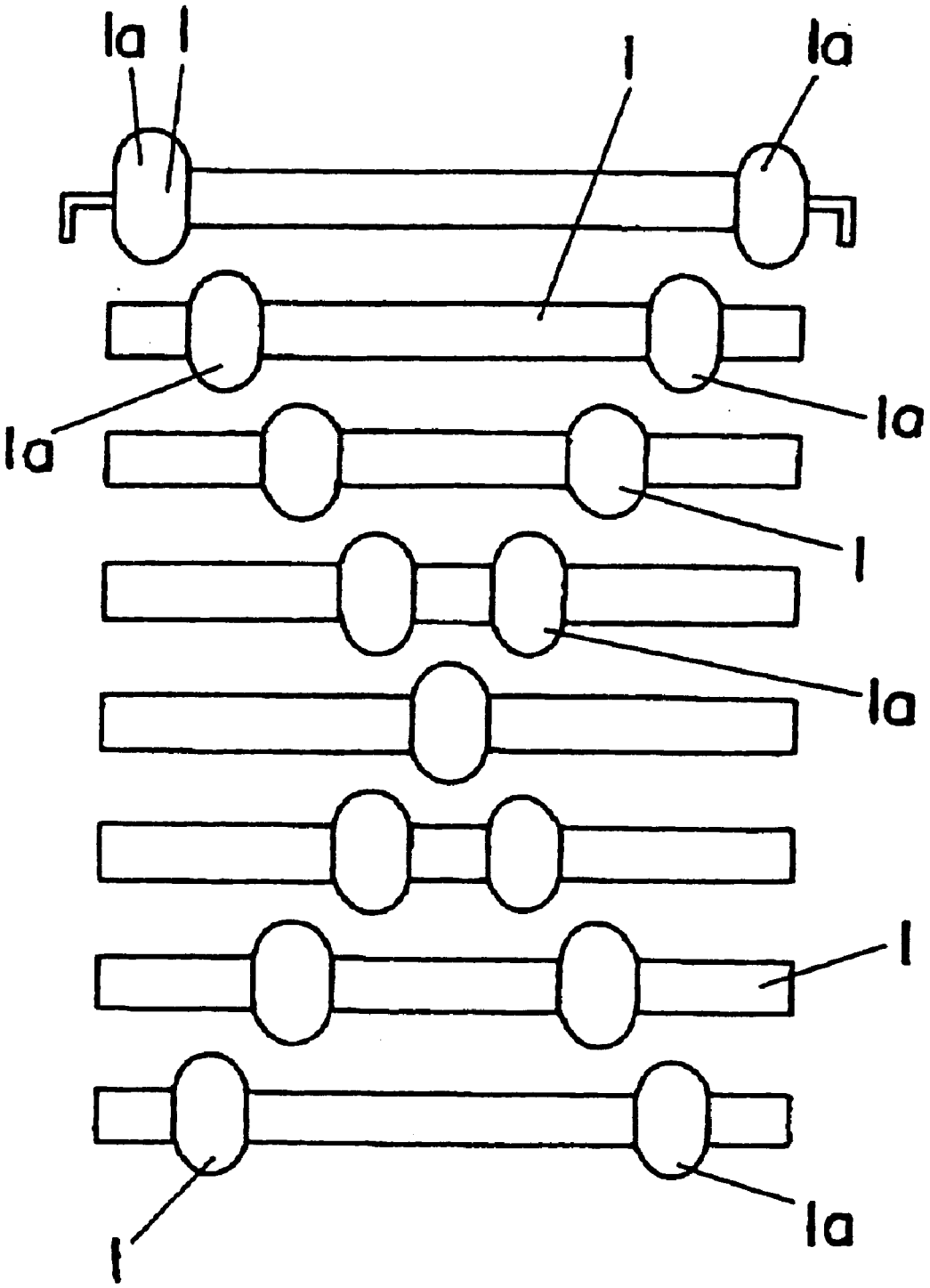
FIG. 21 is an explanatory view showing an embodiment including a plurality of rollers with different shapes.

In the roller massaging apparatus 4 according to the present invention, a plurality of rollers 1 are circumferentially mounted on the massaging portion 2 and each roller 1 of the plurality of rollers 1 may be different in shape from one another. The massaging portion 2 having different shaped rollers 1 give stimulus changes by changing the position of the rollers 1 when the massaging portion 2 rotates. FIG. 21 is an unfolded view of the rollers 1 showing an embodiment in which the rollers 1 are different in shape from one another. In this embodiment, the position of the ring-shaped protrusions 1*a* formed on each roller 1 is changed in the axial direction of the roller 1 one by one. Progressively changing the distance between the ring-shaped protrusions 1*a* from the top roller 1 to the bottom roller 1 shown in FIG. 21 enables a massaging effect wherein the portion to be massaged, for example, the sole of the user's foot, is widened or compressed in the axial direction of the roller 1.

Figure 22A:
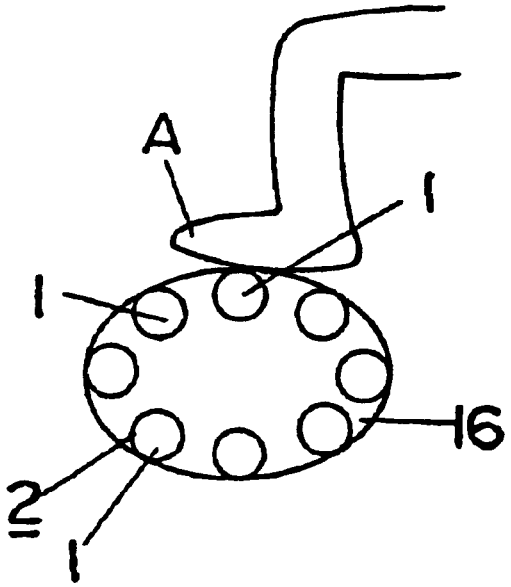
FIGS. 22A and 22B are explanatory views of an embodiment in use, which has a plurality of rollers disposed in an elliptical arrangement.
Figure 22B:
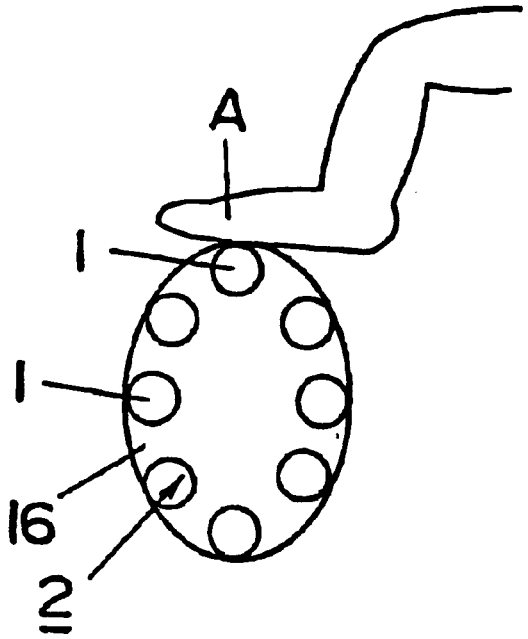
Figure 23:
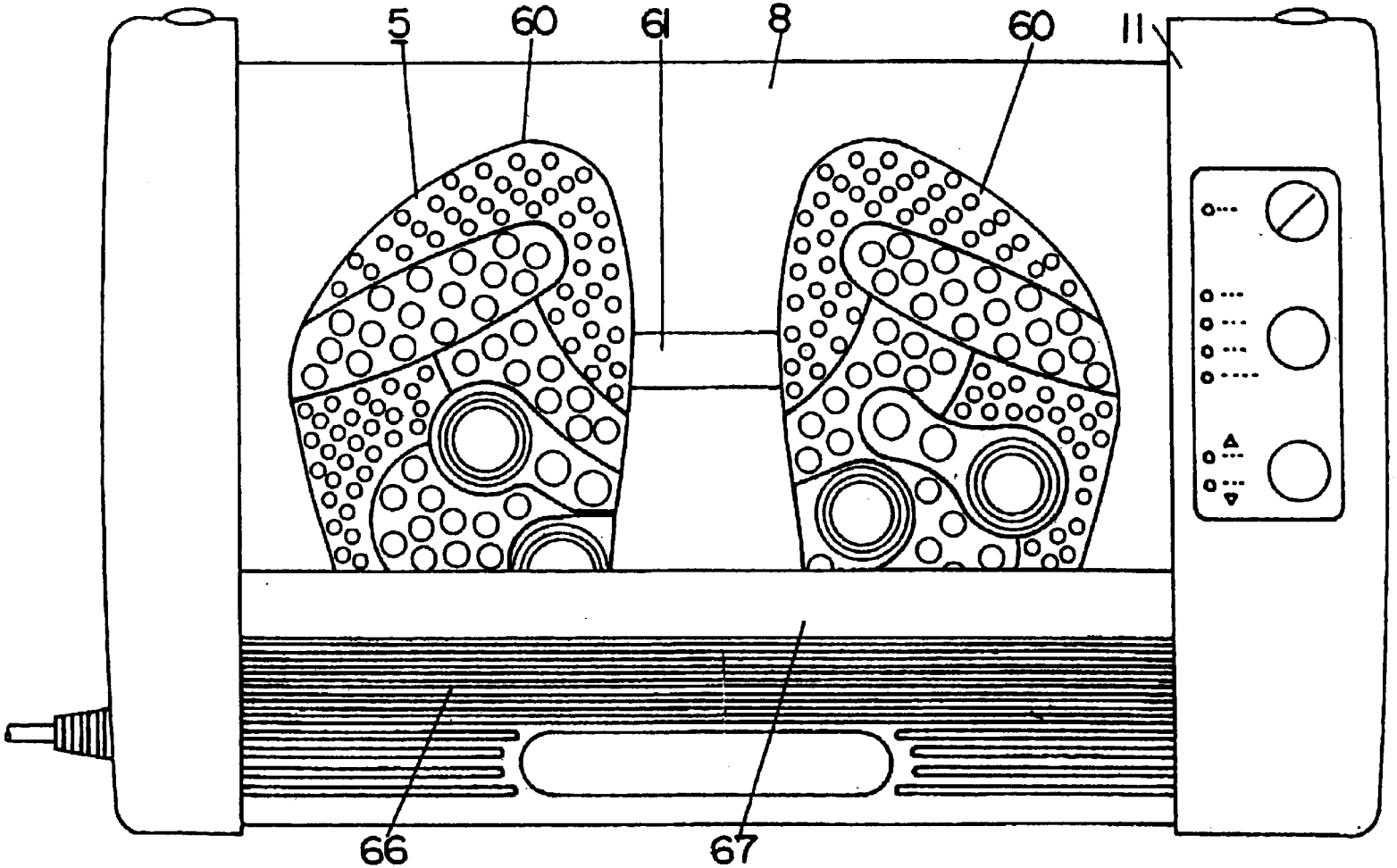
FIG. 23 is a plan view of a fifth embodiment according to the present invention.

Further, in the roller massage apparatus 4 according to the present invention, the massaging portion 2, having a circumferentially mounted plurality of bar-shaped rollers 1, may be oval in cross-section. In detail, the end plate 16, mounting the rollers 1, is formed to be oval. When the massaging portion 2 is rotated around the axis thereof by the driving mechanism 3, the massaging portion 2 takes a first and second position as shown in FIGS. 22A and 22B, respectively. In the position shown in FIG. 22A, the portion of the user's body to be massaged, such as the sole of the user's foot A, is to be massaged by the semi-minor axis portion of the massaging portion 2. In the position shown in FIG. 22B, the portion of the user's body to be massaged, such as the sole of the user's foot A, is to be massaged by the semi-major axis portion of the massaging portion 2. In the first position shown in FIG. 22A, soft stimulus massage can be performed, whereas in the second position shown in FIG. 22B, strong stimulus massage can be performed. In both the first and second positions shown in FIGS. 22A and 22B, respectively, the massaging portion 2 may be held in its position by position holding means so as to steadily massage the sole of the user's foot.

In one embodiment of the present invention, the roller massaging apparatus includes a massaging portion having a plurality of bar-shaped rotatable rollers, wherein the rollers are circumferentially mounted to the massaging portion at a certain interval. The roller massaging apparatus also includes a driving mechanism for rotating the massaging portion around an axis thereof and a stimulating member disposed at an upper side of the massaging portion. The stimulating member is pushed up by the rollers. A mutual positional relationship between the massaging portion and the stimulating member is changed by moving at least one of the massaging portion and the stimulating member. Therefore, a part of a user's body placed on the stimulating member is strongly stimulated by the stimulating member pushed up by a plurality of rollers when the massaging portion is rotated. Massaging effects by the stimulating member can be changed by changing the mutual positional relationship between the massaging portion and the stimulating member by moving at least one of the massaging portion and the stimulating member.

With respect to the above-described embodiment, the mutual positional relationship between the massaging portion and the stimulating member is changed by moving the stimulating member. The moving of the stimulating member allows for a change in the massaging effects to be obtained by the stimulating member.

With respect to the above-described embodiment, the stimulating member is detachably attached to the roller massaging apparatus. This allows for the cleaning of the stimulating member by detaching it, exchanging the stimulating member when it is worn down, exchanging the stimulating member for a different one to obtain a different stimulus, and detaching the stimulating member to obtain less stimulating massaging effects.

With respect to the above-described embodiment, the stimulating member is movable and the roller massaging apparatus further include a stopping means for stopping and holding the stimulating member at a certain position. This enables the stimulating member to stop at a desired position to massage at predetermined stimulus level.

With respect to the above-described embodiment, the stimulating member is provided with a plurality of regions each having different shaped stimulating protrusions. By moving the stimulating member, different massaging effects can be obtained by the different shaped stimulating protrusions.

With respect to the above-described embodiment, the stimulating member is preferably provided with a region having stimulating protrusions and a region not having stimulating protrusions so as to obtain strong stimulus from the region having stimulating protrusions and soft stimulus from the region not having stimulating protrusions.

With respect to the above-described embodiment, the stimulating member is provided with a foot-shaped region having stimulating protrusions thereon to effectively massage the sole of the user's foot.

With respect to the above-described embodiment, the foot-shaped region is provided with stimulating protrusions at portions of the sole of the user's foot to be massaged which correspond to pressure points. This allows for effective massage of the sole of the user's foot.

With respect to the above-described embodiment, the stimulating member is provided with right and left foot-shaped regions having stimulating protrusions, wherein the stimulating protrusions of the right and left foot-shaped regions are different in position so as to correspond to specific pressure points which are different for the right and left foot. This allows for more effective massage of the sole of the user's right and left foot.

With respect to the above-described embodiment, the stimulating member is provided with a positioning means for correctly positioning the user's foot thereon. This allows for more effective massage of the sole of the user's foot because the correct position the user's foot places the portions of the user's foot on the stimulating protrusions to best reach the pressure points.

With respect to the above-described embodiment, the stimulating member is formed by elastic materials. This enables easy response of the stimulating member according to the stimulus of the rotation of the roller, which in turn more easily transmits the rotational stimulus to the body part of the user from the stimulating member.

With respect to the above-described embodiment, the stimulating member is attached on a movable sheet. When the stimulating member is made of an elastic material, the stimulating member is difficult to move because the elastic material does not slide easily due to a large friction force. However, the sheet having the stimulating means attached thereto can easily be moved because of the sheet material has a smaller associated friction force. Furthermore, the sheet has a region with no stimulating members thereon which allows for the same massaging effects to be obtained as the massaging effects obtained by a sheet having absolutely no stimulating member thereon. Thus, if the roller includes a region having no stimulating members there, the complete removal of the stimulating member from the sheet is unnecessary.

With respect to the above-described embodiment, the stimulating member is detachably attached to the sheet. This enables the user to easily use the massaging apparatus, without the stimulating member, by simply detaching the stimulating member.

With respect to the above-described embodiment, the sheet having stimulating members thereon is detachably mounted on the roller massaging apparatus. This enables the user to easily clean the dirty stimulating member, to replace a worn out stimulating member with a new one, or to exchange the stimulating member for a stimulating member having a different stimulating level. This also allows for a less stimulating massage to be obtained than the massage obtained from the conventional massaging apparatus, without using the stimulating member.

With respect to the above-described embodiment, the sheet having a stimulating member thereon is placed around sheet rotating rollers. This enables smooth movement of the sheet having the stimulating members thereon.

With respect to the above-described embodiment, the roller massaging apparatus is provided with a stopping means for stopping and holding the sheet having stimulating members thereon at a certain position. This enables the stimulating member to hold at a desired position, thereby enhancing massaging stimulus.

With respect to the above-described embodiment, the roller massaging apparatus is provided with a driving means for driving the stimulating member, thereby automatically moving the stimulating member to a desired position.

With respect to the above-described embodiment, each of the stimulating members have a plurality of massaging sheets and first and second massaging sheets are each connected with one another by a connecting member. This enables easy and correct movement of a first massaging sheet when the second massaging sheet is moved.

With respect to the above-described embodiment, the stimulating members are provided on right and left massaging sheets and the right and left massaging sheets are connected by connecting members at fore-and-aft portions of a moving direction of the stimulating member. This enables one of the right and left massaging sheets to move when the other of the left and right massaging sheets is moved and also allows for clear distinguishing of the left and right massaging sheets from the connecting members, thereby making the foot placing area clear. Further, because the connecting members are formed at fore-and-aft portions, the massaging sheets can be effectively pushed up by the roller without extensively hindering by the connecting members.

With respect to the above-described embodiment, the stimulating member is movable so as to take either a first position wherein the stimulating member is located above the massaging portion or a second position wherein the stimulating member is not located above the massaging portion. The roller massaging apparatus may further include a stimulating member moving portion for moving the stimulating member when the stimulating member is not positioned above the massaging portion. This enables the user to select the massage with the stimulating member and the massage without the stimulating member. This also enables the stimulating member to easily move from the position wherein the stimulating member is not positioned above the roller to the position wherein the stimulating member is positioned above the massaging portion by means of pushing the stimulating member moving portions.

With respect to the above-described embodiment, the stimulating member is automatically moved to predetermined positions. This also enables the massage stimulus to be similar to the massaging pattern of a professional massager.

With respect to the another embodiment of the present invention, a roller massaging apparatus includes a massaging portion having a plurality of bar-shaped rotatable rollers, wherein the rollers are circumferentially mounted on the massaging portion at a certain interval, a driving mechanism for rotating the massaging portion around an axis thereof, and a control means for automatically changing rotational speed and/or rotational direction of the rollers. This enables the massage stimulus to be similar to the massaging pattern of a professional massager.

With respect to still another embodiment of the present invention, a roller massaging apparatus includes a massaging portion having a plurality of bar-shaped rotatable rollers, wherein the rollers are circumferentially mounted on the massaging portion at a certain interval, a driving mechanism for rotating the massaging portion around an axis thereof, and a control means for controlling a rotational speed of the massaging portion so as to start at a predetermined low speed in the beginning stage of the rotation of the massaging portion. According to the immediately above-described embodiment, as the stimulating member begins to move slowly at the beginning stage, the user will not be surprised due to a sudden start and will not receive sudden stimulus at the very beginning stage to thereby allow for more user safety to and to allow for a soft start.

With respect to the immediately above-described embodiment, a rotational direction of the massaging portion at the beginning stage is automatically controlled such that the massaging portion rotates in the direction from the toe side to the heel side of the user's foot. This enables the stagnant or unoxygenated blood to be circulated and exchanged for fresh or oxygenated blood at the beginning stage of the massage similar to the massaging patterns of a professional massager.

With respect to still another embodiment of the present invention, a roller massaging apparatus includes a massaging portion having a plurality of bar-shaped rotatable rollers, wherein the rollers are circumferentially mounted on the massaging portion at a certain interval and the rollers are detachably mounted to the massaging portion, and a driving mechanism for rotating the massaging portion around an axis thereof. According to the immediately above-described embodiment, different massaging effects can be obtained by changing the number of rollers to be mounted to the massaging portion. Further, the smaller the number of rollers, the stronger the massage becomes because of the larger up-and-down movements on the portion of the user's body to be massaged, such as the sole of the user's foot. To the contrary, the larger the number of rollers, the softer the massage becomes because of the smaller up-and-down movements on the portion of the user's body to be massaged, such as the sole of the user's foot.

With respect to still another embodiment of the present invention, a roller massaging apparatus includes a massaging portion having a plurality of bar-shaped rotatable rollers, wherein each roller of the plurality of rollers are circumferentially mounted on the massaging portion at a certain interval and each roller of the plurality of rollers is different in shape, and a driving mechanism for rotating the massaging portion around an axis thereof. The massaging portion having different shaped rollers gives stimulus changes by changing the position of the rollers when the massaging portion rotates.

With respect to still another embodiment of the present invention, a roller massaging apparatus includes a massaging portion having a plurality of bar-shaped rotatable rollers, wherein the rollers are circumferentially mounted on the massaging portion at a certain interval and wherein the massaging portion is oval in cross-section, and a driving mechanism for rotating the massaging portion around an axis thereof. This enables the semi-minor axis portion of the roller to massage the body part of the user of the massager and also enables the semi-major axis portion of the roller to massage the body part of the user of the massager. The semi-minor axis portion of the roller gives soft stimulus massage, whereas the semi-major axis portion of the roller gives strong stimulus massage.

The terms and expressions which have been employed herein are used as terms of description and not of limitation, and there is no intent, in the use of such terms and expressions, of excluding any equivalents of the features shown and described or portions thereof, but it should be recognized that various modifications are possible within the spirit and scope of the invention claimed.

The entire disclosure of Japanese Patent Application No. 9-157204 filed on Jun. 13, 1997 each including the specification, claims, drawing figures and abstract are incorporated herein by reference in its entirety.

What is claimed is:

1. A roller massaging apparatus, comprising:

a massaging portion having a plurality of bar-shaped rotatable rollers, said rollers being circumferentially mounted to said massaging portion at a certain interval;

a driving mechanism for rotating said massaging portion around an axis thereof; and a stimulating member having a plurality of stimulating protrusions each one adapted to contact a different part of a user's foot, said stimulating member being disposed at an upper side of said massaging portion so that a certain portion of said stimulating member is pushed up by said rollers, wherein said stimulating member is shiftable in a generally circumferential direction relative to said massaging portion and independently therefrom such that said certain portion to be pushed up by said rollers is also shifted in a generally circumferential direction relative to said massaging portion.

2. The roller massaging apparatus as recited in claim 1, wherein said mutual positional relationship between said massaging portion and said stimulating member is changed by moving said stimulating member.

3. The roller massaging apparatus as recited in claim 2, wherein said stimulating member is movable, and further comprising a stopping means for stopping and holding said stimulating member at a certain position.

4. The roller massaging apparatus as recited in claim 3, further comprising a stopping means to stop and hold said sheet with said stimulating member at a certain position.

5. The roller massaging apparatus as recited in claim 2, wherein said stimulating member is provided with a foot-shaped region with stimulating protrusions thereon.

6. The roller massaging apparatus as recited in claim 5, wherein said foot-shaped region is provided with said stimulating protrusions at points corresponding to a portion of a sole of a foot to be massaged of a user of said roller massaging apparatus.

7. The roller massaging apparatus as recited in claim 6, wherein said stimulating member is provided with said foot-shaped regions having said stimulating protrusions for a left foot and for a right foot, said stimulating protrusions of said foot-shaped regions for said left foot and for said right foot are different in position so as to correspond to points on said left foot and said right foot to be massaged.

8. The roller massaging apparatus as recited in claim 7, wherein said stimulating member is provided with a positioning means for positioning any one of said left foot and said right foot.

9. The roller massaging apparatus as recited in claim 2, wherein said stimulating member is attached on a movable sheet wherein, said movable sheet is rotatably put around said massaging portion such that a certain region of said movable sheet is disposed on said massaging portion.

10. The roller massaging apparatus as recited in claim 9, wherein said stimulating member is detachably attached on said sheet.

11. The roller massaging apparatus as recited in claim 9, wherein said stimulating member is detachably attached on said movable sheet.

12. The roller massaging apparatus as recited in claim 9, further comprising a stopping means to stop and hold said sheet with said stimulating member at a certain position.

13. The roller massaging apparatus as recited in claim 9, wherein said stimulating member has a plurality of massaging sheets, said massaging sheets being connected with each other by a connecting member.

14. The roller massaging apparatus as recited in claim 13, wherein said stimulating member is provided with a right massaging sheet and a left massaging sheet of said plurality of massaging sheets, said right massaging sheet being connected to said left massaging sheet by said connecting member at fore-and-aft portions of a moving direction of said stimulating member.

15. The roller massaging apparatus as recited in claim 9, wherein said stimulating member is movable so as to take any one of a first massaging position wherein said stimulating member is located above said massaging portion and a second massaging position wherein said stimulating member is not located above said massaging portion, and further comprising a stimulating member moving portion for moving said stimulating member which located in said second massaging position.

16. The roller massaging apparatus as recited in claim 2, further comprising a driving means for driving said stimulating member.

17. The roller massaging apparatus as recited in claim 2, wherein said stimulating member has a plurality of massaging sheets, said massaging sheets being connected with each other by a connecting member.

18. The roller massaging apparatus as recited in claim 17, wherein said stimulating member is provided with a right massaging sheet and a left massaging sheet of said plurality of massaging sheets, said right massaging sheet being connected to said left massaging sheet by said connecting member at fore-and-aft portions of a moving direction of said stimulating member.

19. The roller massaging apparatus as recited in claim 2, wherein said stimulating member is automatically moved to predetermined positions.

20. The roller massaging apparatus as recited in claim 1, wherein said stimulating member is detachably attached to said roller massaging apparatus.

21. The roller massaging apparatus as recited in claim 1, wherein said stimulating member is provided with a plurality of regions, each region of said plurality of regions having stimulating protrusions thereon and said stimulating protrusions being different in shape.

22. The roller massaging apparatus as recited in claim 1, wherein said stimulating member is provided with a region having said stimulating protrusions thereon and a region not having said stimulating protrusions thereon.

23. The roller massaging apparatus as recited in claim 1, wherein said stimulating member is provided with a foot-shaped region with stimulating protrusions thereon.

24. The roller massaging apparatus as recited in claim 23, wherein said foot-shaped region is provided with said stimulating protrusions at points corresponding to a portion of a sole of a foot to be massaged of a user of said roller massaging apparatus.

25. The roller massaging apparatus as recited in claim 24, wherein said stimulating member is provided with said foot-shaped regions having said stimulating protrusions for a left foot and for a right foot, said stimulating protrusions of said foot-shaped regions for said left foot and for said right foot are different in position so as to correspond to points on said left foot and said right foot to be massaged.

26. The roller massaging apparatus as recited in claim 25, wherein said stimulating member is provided with a positioning means for positioning any one of said left foot and said right foot.

27. The roller massaging apparatus as recited in claim 1, wherein said stimulating member is formed from elastic materials.

* * * * *